US010047562B1

(12) United States Patent
Cherrington

(10) Patent No.: US 10,047,562 B1
(45) Date of Patent: Aug. 14, 2018

(54) HORIZONTAL DIRECTIONAL DRILLING TOOL WITH RETURN FLOW AND METHOD OF USING SAME

(71) Applicant: Martin Cherrington, Fair Oaks, CA (US)

(72) Inventor: Martin Cherrington, Fair Oaks, CA (US)

( * ) Notice: Subject to any disclaimer, the term of this patent is extended or adjusted under 35 U.S.C. 154(b) by 0 days.

(21) Appl. No.: 15/729,455

(22) Filed: Oct. 10, 2017

(51) Int. Cl.

| | |
|---|---|
| ***E21B 7/04*** | (2006.01) |
| ***E21B 21/00*** | (2006.01) |
| ***E21B 17/10*** | (2006.01) |
| ***E21B 3/02*** | (2006.01) |

(52) U.S. Cl.
CPC ..... *E21B 7/046* (2013.01); *E21B 17/1014* (2013.01); *E21B 17/1078* (2013.01); *E21B 21/00* (2013.01); *E21B 3/02* (2013.01)

(58) Field of Classification Search
CPC . E21B 7/04; E21B 21/00; E21B 21/12; E21B 7/28; E21B 7/06; E21B 7/201; E21B 7/00; E21B 7/046; E21B 7/062; E21B 17/1014; E21B 17/1078; E21B 3/02
See application file for complete search history.

(56) References Cited

U.S. PATENT DOCUMENTS

| | | | |
|---|---|---|---|
| 1,907,012 | A | 5/1933 | Smith |
| 2,002,893 | A | 5/1935 | Holt et al. |
| 2,959,453 | A | 11/1960 | Jacobs |
| 3,741,252 | A | 6/1973 | Williams |
| 3,878,903 | A | 4/1975 | Cherrington |
| 3,894,402 | A | 7/1975 | Cherrington |
| 3,967,201 | A | 6/1976 | Rorden |
| 3,967,689 | A | 7/1976 | Cherrington |
| 3,996,758 | A | 12/1976 | Cherrington |
| 4,003,440 | A | 1/1977 | Cherrington |
| 4,051,911 | A | 10/1977 | Cherrington |
| 4,078,617 | A | 3/1978 | Cherrington |
| 4,091,631 | A | 5/1978 | Cherrington |
| 4,121,673 | A | 10/1978 | Cherrington |
| 4,135,586 | A | 1/1979 | Cherrington |
| 4,167,985 | A | 12/1979 | Cherrington |

(Continued)

FOREIGN PATENT DOCUMENTS

| | | |
|---|---|---|
| CA | 2873712 | 11/2016 |

OTHER PUBLICATIONS

"Case History Showing the Financial Effects of HDD Frac-Out Remediation", P-1045 Potable Water Conveyance Project at Camp Pedleton, CA, 2 pages.

(Continued)

*Primary Examiner* — Wei Wang
(74) *Attorney, Agent, or Firm* — JL Salazar Law Firm

(57) ABSTRACT

A horizontal directional drilling tool and method for drilling a borehole through a subsurface formation between locations at a surface is disclosed. The drilling tool includes a bit, an outer tube, an inner tube, and rotational drivers. The outer tube is coupled to a surface driver. The inner tube is coupled between the surface driver and the bit to translate rotation therebetween. The inner tube has a drilling fluid passage therethrough, and is positioned within the outer tube to define a return flow passage therebetween. The rotational drivers include propulsors coupled to the inner tube. The propulsors comprise blades extending into the return flow passage and rotationally driven therein whereby returns in the borehole are urged uphole.

42 Claims, 23 Drawing Sheets

(56) References Cited

U.S. PATENT DOCUMENTS

| | | | |
|---|---|---|---|
| 4,176,985 | A | 12/1979 | Cherrington |
| 4,221,503 | A | 9/1980 | Cherrington |
| 4,319,648 | A | 3/1982 | Cherrington |
| 4,398,772 | A | 8/1983 | Odell |
| 4,401,170 | A | 8/1983 | Cherrington |
| 4,618,008 | A | 10/1986 | Cherrington |
| 4,679,637 | A | 7/1987 | Cherrington et al. |
| 4,691,203 | A | 9/1987 | Rubin et al. |
| 4,710,708 | A | 12/1987 | Rorden et al. |
| 4,725,837 | A | 2/1988 | Rubin |
| 4,784,230 | A | 11/1988 | Cherrington |
| 4,785,885 | A | 11/1988 | Cherrington |
| 4,875,014 | A | 10/1989 | Roberts et al. |
| 4,899,835 | A | 2/1990 | Cherrington |
| 5,096,002 | A | 5/1992 | Cherrington |
| 5,160,925 | A | 11/1992 | Dailey et al. |
| 5,209,605 | A | 5/1993 | Cherrington |
| 5,230,388 | A | 7/1993 | Cherrington |
| 5,269,384 | A | 12/1993 | Cherrington |
| 5,351,764 | A | 10/1994 | Cherrington |
| 5,375,669 | A | 12/1994 | Cherrington |
| 5,375,945 | A | 12/1994 | Cherrington |
| 5,456,552 | A | 10/1995 | Cherrington |
| 5,490,569 | A | 2/1996 | Brotherton et al. |
| 6,017,095 | A | 1/2000 | Dimillo |
| 6,021,377 | A | 2/2000 | Dubinsky et al. |
| 6,257,356 | B1 | 7/2001 | Wassell |
| 6,276,550 | B1 | 8/2001 | Cherrington |
| 6,328,119 | B1 | 12/2001 | Gillis et al. |
| 6,626,254 | B1 | 9/2003 | Krueger et al. |
| 6,659,200 | B1 | 12/2003 | Eppink |
| 6,827,158 | B1 | 12/2004 | Dimitroff et al. |
| 6,851,490 | B2 | 2/2005 | Cherrington |
| 6,854,190 | B1 | 2/2005 | Lohmann |
| 7,025,152 | B2 | 4/2006 | Sharp et al. |
| 7,252,160 | B2 | 8/2007 | Dopf et al. |
| 7,762,356 | B2 | 7/2010 | Turner et al. |
| 7,942,609 | B2 | 5/2011 | Koegler |
| 7,963,722 | B2 | 6/2011 | Koegler |
| 8,336,654 | B1 | 12/2012 | Robson et al. |
| 8,628,273 | B2 | 1/2014 | Cherrington |
| 8,998,537 | B2 | 4/2015 | Cherrington |
| 9,534,705 | B2 | 1/2017 | Cherrington |
| 2013/0068490 | A1 | 3/2013 | Van Zee et al. |
| 2014/0305709 | A1 | 10/2014 | Slaughter, Jr. et al. |

OTHER PUBLICATIONS

Composite Thread Protectors, Revata Engineering, http://www.revataoiltools.com/products/oilfield-division/thread-tubular-protection-systems/composite-thread-protector-tubing-casin, accessed Oct. 11, 2017, 2 pages.

Manual on Pumps Used as Turbines, Appendix B: Basic theory of Hydraulic Machines, Jun. 17, 2015, Nov. 2018.

"Martin D Cherrington Bio", 2 pages.

Premiere performance for Direct Pipe in USA, Herrenknect News Release in TunnelTalk, www.tunneltalk.com, Nov. 2010.

Reelwell Drilling Method, Product Brochure, www.reelwell.no/Technology.

"US Patents by: Martin (D.) Cherrington", Mar. 22, 2017, 2 pages.

Ahmed, Ramadan M. et al., Experimental Studies on the Effect of Mechanical Cleaning Devices on Annular Cuttings Concentration and Applications for Optimizing ERD Systems, SPE Annual Technical Conference and Exhibition, Sep. 19-22, 2010, Florence, Italy, 2010.

Centerpoint Energy, et al., Horizontal Directional Drill and Contingency Plan, Bear Den Project Plan of Development, Prepared for Bureau of Land Management, Jun. 2013.

Elite Multiphase Solutions, et al., 538 Serries V-Pump, www.elitemps.com.

Francis,D. et al., Extended-reach drilling systems address downhole challenges, Offshore, www.offshore-mag.com, Sep. 17, 2014, 5-8.

Herrenknect, et al., Direct Pipe product Brochure, www.herrenknect.com/en/directpipe.

Herrenknect, M. et al., Microtunneling with Herrenknect MicroMachines, Presentation at Colorado School of Mines, Mar. 28, 2003.

Herrenknect Tunnelling Systems, et al., Direct Pipe, Pipeline installation in one step.

Iseki Microtunnelling, et al., Welcome to Iseki Microtunnelling, www.isekimicro.com, May 24, 2017.

Koegler, R. et al., "HDB, Easy Pipe, and Direct Pipe Evaluation, Horizontal Directional Boring (HDB)—The forerunner of Easy and Direct Pipe Pipe", Machine Translation from German.

Kogler, R. et al., Easy Pipe—a New Technology for Trenchless Installation of Large Diameter Steel Pipelines, Pipeline Technology 2006 Conference, 2006.

Latorre, Carlos A. et al., Guidelines for Installation of Utilities Beneath Corps of Engineers Levees Using Horizontal Directional Drilling, US Army Corps of Engineer Report, ERDC/GSL TR-02-9, Jun. 2002.

Li, Z. et al., Design and Matching Calculation of Hydraulic Helical Axial Multiphase Pump, Advanced Materials Research, vol. 201-203, 454-459, Feb. 21, 2011.

Lubberger, M. et al., Extending the Achievement Portfolio of HDD Rigs, International No-Dig 2011 29th International Conference and Exhibition, Paper 1-B-04-1, May 2-5, 2011, 6-10.

Merriam-Webster Unabridged, et al., propulsor, Jun. 6, 2017.

Meyer & John, et al., Easy Pipe Product Brochure, www.meyer-john.de.

Oil and Gas Online, et al., "Reelwell Introduce New Drilling Method Helps Getting More Oil Out, Reelwell Introduce New Drilling Method Helps Getting More Oil Out", Sep. 2, 2008, Oil and Gas Online, Sep. 2, 2008.

Pospiech, P. et al., VOITH's New Propulsion System: THe Voith Linear Jet (VLJ), Maritime Propulson, articles. maritimepropulsion.com, Nov. 23, 2012.

Puymbroeck, Van L. et al., Increasing Drilling Performance for ERD Wells using New Generation Hydro-Mechanical Drill Pipe, 2013 AADE National Technocal Conference, Oklahoma City, OK, Feb. 26-27, 2013.

Rantanen, J. et al., *Charles Machine Works* v. *Vermeer Mfg*: CAFC continues rolling back the vitiation doctrine, Patently-O, www.patentlyo.com, Jul. 26, 2013.

Robison, Jonathan L. et al., Direct Pipe Levee Crossing Design—Mitigating Hydraulic Fracture Risk, North American Society for Trenchless Technology (NASTT), NASTT's 2015 No-Digg Show, Denver, CO, Paper WM-T4-04, Mar. 15-19, 2015.

Smart Drilling GMBH, et al., Innovation Mud driven Generator, www.smartdrilling.com, Jun. 6, 2017.

Vallourec, et al., Hydroclean, Hydroclean product brochure.

Weiner, S. et al.,Trenchless Installation of Utility Tunnels, UNITRACC.com, Jun. 29, 2006, 1-2.

HORIZONTAL DIRECTIONAL DRILLING TOOL WITH RETURN FLOW AND METHOD OF USING SAME

BACKGROUND

This present disclosure relates generally to drilling operations. More specifically, the present disclosure relates to Horizontal Directional Drilling (HDD) techniques used in forming boreholes for the installation of infrastructure lines for utility, distribution, and transmission underground infrastructures.

Underground infrastructure lines may be installed between locations along surface or subsurface paths. Such underground infrastructure lines may include power, water, wastewater, fiber optics, gas, or petrochemical lines. The installation of underground infrastructure lines may encounter obstacles, such as roads, hills, structures, bodies of water, environmentally sensitive areas, etc. To circumvent such obstacles, the underground infrastructure lines may be installed by horizontally drilling subsurface paths between the locations and passing the underground infrastructure lines through such subsurface paths.

The subsurface paths are formed by drilling boreholes from a first location into subsurface formations and exiting at a second surface location a distance from the first location. In some cases, the boreholes extend a distance between locations below the surface to pass below the obstacles. For example, the boreholes may be drilled from the first location on one side of a river, pass below the river, and exit at the second location on another side of the river. The underground infrastructure lines are then passed through the borehole to commonly connect to infrastructure equipment on both sides of the river.

The borehole may be drilled using drilling equipment including a drilling rig for advancing a drilling tool through the subsurface formation. The drilling tool includes a drill string with a bit at a distal end thereof. This drilling equipment may directionally drill the borehole. Examples of drilling equipment are described in U.S. Pat. Nos. 7,942,609, 6,854,190, 4,319,648, 5,490,569, 5,209,605, and 4,221,503, the entire contents of which are hereby incorporated by reference herein.

Despite advances in underground infrastructure drilling, there remains a need to provide efficient and effective HDD techniques capable of operating in a variety of formations and/or preventing damage to the borehole and surrounding formation, such as drill mud frac-outs, collapse, dog-leg-severity, tortuosities, etc., that may occur during drilling. The present disclosure is directed at such needs.

SUMMARY

In at least one aspect, the present disclosure relates to a horizontal directional drilling tool for drilling a borehole through a subsurface formation between locations about a surface. The drilling tool comprises a bit, an outer tube, an inner tube, and rotational drivers. The outer tube coupled to a surface driver. The inner tube is coupled between the surface driver and the bit to translate rotation therebetween. The inner tube has a drilling fluid passage therethrough. The inner tube is positioned within the outer tube to define a return flow passage therebetween. The rotational drivers comprise propulsors coupled to the inner tube. The propulsors comprise blades extending into the return flow passage and rotationally driven therein whereby returns in the borehole are urged uphole.

In another aspect the disclosure relates to a horizontal directional drilling system for drilling a borehole through a subsurface formation between locations about a surface. The drilling system comprises a surface driver, and a horizontal directional drilling tool. The drilling tool comprises a bit, an outer tube, an inner tube, and rotational drivers. The outer tube coupled to a surface driver. The inner tube is coupled between the surface driver and the bit to translate rotation therebetween. The inner tube has a drilling fluid passage therethrough. The inner tube is positioned within the outer tube to define a return flow passage therebetween. The rotational drivers comprise propulsors coupled to the inner tube. The propulsors comprise blades extending into the return flow passage and rotationally driven therein whereby returns in the borehole are urged uphole.

Finally, in another aspect, the disclosure relates to a method for directionally drilling a horizontal borehole through a subsurface formation between locations about a surface. The method comprises; providing a drilling tool comprising an inner tube, an outer tube, and a bit; advancing the bit into the subsurface formation by axially driving the outer tube and rotationally driving the bit via the inner tube; passing a drilling fluid through the inner tube and out the bit, the drilling fluid mixing with cuttings generated by the bit to form returns; and urging the returns from the borehole to the surface by rotating rotational drivers in a return flow passage between the inner tube and the outer tube.

This summary is not intended to limit the disclosure. Other features are contemplated as set forth further herein.

BRIEF DESCRIPTION OF THE DRAWINGS

So that the above recited features and advantages can be understood in detail, a more particular description, briefly summarized above, may be had by reference to the embodiments thereof that are illustrated in the appended drawings. It is to be noted, however, that the examples illustrated are not to be considered limiting of its scope. The figures are not necessarily to scale and certain features and certain views of the figures may be shown exaggerated in scale or in schematic in the interest of clarity and conciseness.

DETAILED DESCRIPTION

Figure 1A:
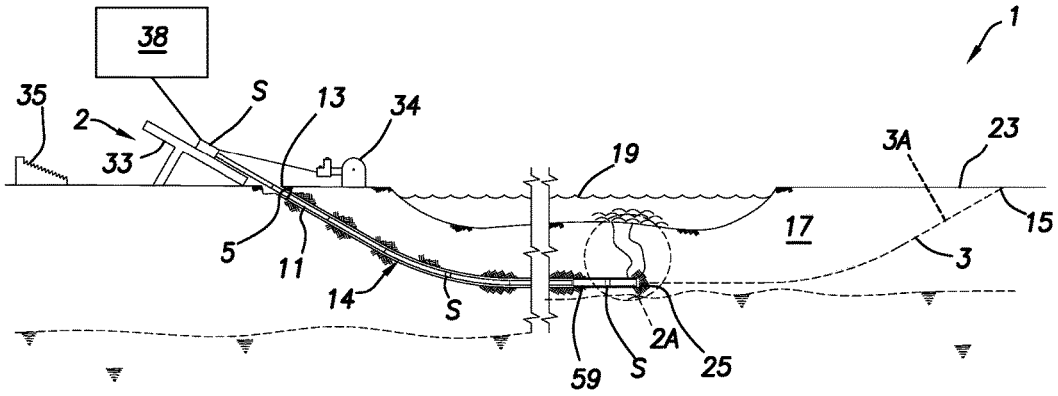
FIGS. 1A-1C are schematic diagrams, partially in cross-section of an HDD site having HDD equipment with return flow capability for performing HDD operations including drilling a borehole into a subsurface formation, reaming the borehole, and installing an infrastructure line in the borehole, respectively.

The description that follows includes exemplary apparatus, methods, techniques, and/or instruction sequences that embody techniques of the present subject matter. However, it is understood that the described embodiments may be practiced without these specific details.

The present disclosure relates to HDD techniques (e.g., tools, systems, and methods) for drilling subsurface boreholes for the passage of underground infrastructure lines (e.g., lines for utility, distribution, and transmission for power, water, wastewater, fiber optics, gas, petrochemical, formation drainage, seawater inlets, etc.) between surface locations. The drilling techniques may include an HDD tool with internal passages for both passing drilling fluid from the surface through the HDD tool and passing returns (e.g., bit cuttings, borehole solids, borehole fluids, etc.) back to the surface during drilling.

The return flow features of the HDD tool may be used to draw in, break down, pass, and/or manipulate returns, to assist in maintaining solids suspension, and/or to prevent blockage of returns from the borehole to the surface. The HDD tool may also be configured to control and/or mitigate damage to the borehole and/or surrounding formation, such as frac-outs, dog-leg severity, tortuosities, borehole collapse, etc. ("BH Damage"). For example, the HDD tool may facilitate removal of the returns in a manner that seeks to prevent the BH damage. These and/or other features of the HDD tool may be configured to enhance drilling operations in a variety of non-competent formation conditions subject to BH damage, such as soft, weak, fractured, shallow, and/or unconsolidated formations, and/or in horizontal (or near horizontal), shallow subsurface, and/or alluvial weak formations (e.g., soft sands, silts, clays, gravels, or fractured rock, and/or other weak materials).

Frac-outs as used herein refers to the hydro-fracking of the formation surrounding the borehole and/or the inadvertent release of fluid from the borehole into the surrounding formation during drilling. Drill mud frac-outs may occur, for example, when fluid pressure in the borehole (or annulus pressure) exceeds pressure of the formation (or fluid containment of the borehole and/or surrounding formation), and/or where the drilling fluid in the borehole finds openings (e.g., as fault lines, fractures, infrastructure, loose material, etc.) along a wall of the bore. These frac-outs can be natural or induced by over pressurizing the formation.

The frac-less HDD techniques provided herein are intended to prevent the BH damage to the formation while facilitating drilling of the subsurface boreholes. These frac-less HDD techniques seek to provide one or more of the following: isolated drilling fluid and solids return passages, integrated drilling and return components, integrated drilling assembly (e.g., Bottom Hole Assembly (BHA)) and multi-layered drill pipe, urging return flow from the borehole through the BHA and multilayered drill pipe to the surface, clearable fluid passageways, grinding (or milling) during drilling to size and reduce formation cuttings in the returns, measured drilling parameters (e.g., borehole fluid pressure, rate of penetration, weight on bit, azimuth, inclination etc.), concentric drilling fluid and return flow configurations, returns blockage, resistance, protective layering of drilling components, internal devices and methods for assisting in suspension of returns, wear resistance, induced return flow, maintained tool face orientation during unsettling of solids, facilitated removal of cuttings, and/or other capabilities.

Figure 1B:
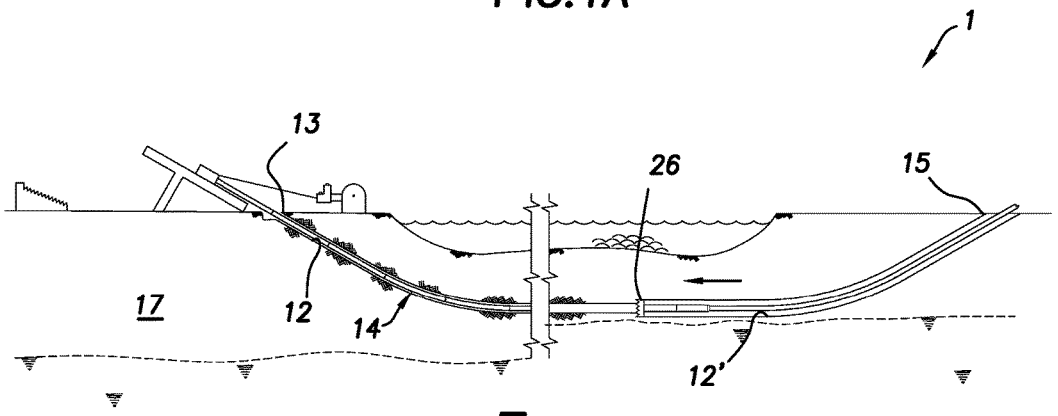
Figure 1C:
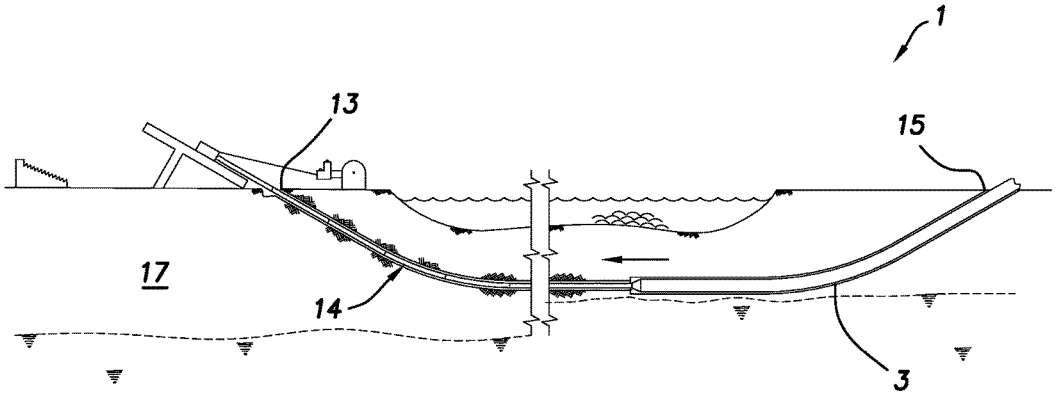

FIGS. 1A-1C show an HDD site 1, including HDD equipment 2 with return flow capabilities usable for performing an HDD operation to install an underground infrastructure line 3. The HDD equipment 2 includes a drill rig 33, a mud pump 34, and solids control 35 positioned at surface 23. The HDD equipment 2 also includes an HDD tool 14 made up of a drill string 11, a BHA 59, and a bit 25. The HDD equipment 2 may include features of conventional drilling equipment. See, e.g., U.S. Pat. Nos. 7,942,609, 6,854,190, 4,319,648, 5,490,569, 5,209,605, and 4,221,503, previously incorporated by reference herein.

The rig 33 may include various mechanisms for connecting the bit 25, BHA 59, portions of the drill string 11, and/or other drilling equipment together to form the HDD tool 14. A series of drill pipes may be threadedly connected together in series by the rig 33 to form the drilling string 11. The BHA 59 and the bit 25 may be connected at a downhole end of the drill string 11 to form the HDD tool 14. The HDD tool 14 is suspended from the drill rig 33 and advanced into formation 17 to form a borehole 12. The rig 33 may include various mechanisms for applying rotational force and axial force to advance and/or retract the HDD tool 14 and the bit 25. The BHA 59 may include various components to facilitate drilling, such as a bent axis directional drilling assembly, mud motor, reamers (hole-openers), and/or other components (not shown).

The HDD tool 14 may have a fluid passage therethrough for passing drilling mud pumped by the mud pump 34 at the surface 23 to the bit 25. The drilling mud exits the HDD tool 14 about the bit 25 as the bit 25 engages and removes cuttings from the formation 17. The HDD tool 14 is provided with return flow capabilities for passing the drilling mud and the cuttings back to the surface 23 as is described further herein.

The HDD tool 14 may be used to perform various HDD operations. The HDD operation may include drilling the borehole (or pilot bore) 12 into the formation 17 as shown in FIG. 1A, reaming the pilot borehole 12 to form a reamed borehole 12' as shown in FIG. 1B, and installing an infrastructure line (or conduit) 3 in the borehole 12 (and/or the reamed borehole 12') as shown in FIG. 1C. The drilling the pilot borehole 12 of FIG. 1A involves advancing the HDD tool 14 into the formation 17 by the rig 33. The HDD tool 14 may pass along a predetermined path from a first surface location (or entry point) 13 through the formation 17 and to a second surface location (or exit point) 15 to form the pilot borehole 12 of a desired geometry. As shown, the path may be an arcuate shape path extending below an obstacle, such as a body of water 19. The pilot borehole 12 may have a given length, such as in excess of about 5,000 feet (1524 m), and/or have a diameter of from about 3 inches (7.62 cm) to about 14 inches (35.56 cm).

The drilling of FIG. 1A may be a one-stage HDD operation. In the one-stage HDD operation, the HDD tool 14 may carry a leave in place drill string 11 into the borehole 12 during drilling. The leave in place drill string 11 may be used to line the pilot borehole 12. Once the leave in drill string 11 is drilled and at permanent rest within the borehole, now acting as a conduit, one or more of the infrastructure lines 3 may be passed through the leave in place drill string 11.

The drilling of FIG. 1A may be performed in a multi-stage operation. For example, in a two-stage operation once the HDD tool exits the exit point 15, the HDD tool 14 may be connected to an infrastructure line 3 and retracted back through the pilot borehole 12 by the rig 33 as shown in FIG. 1C. The line 3 may remain at permanent rest within the borehole 12, and be connected to infrastructure equipment on both sides of the obstacle 19.

In another example, in a three-stage operation, the pilot hole 12 is drilled as in FIG. 1A, As shown in FIG. 1B, once the HDD tool 14 exits the exit point 15, the HDD tool 14 may be provided with one or more reamers 26, each reamer being of the same or different sizes. The HDD tool 14 then may be passed through the borehole 12 to the entry point 13 with the reamer 26 attached thereto to increase a diameter of the pilot borehole 12 to an expanded borehole 12' using the reamer 26. Multiple, or greater diameter line/s 3 may then be installed in the reamed borehole 12' as demonstrated by FIG. 1C.

The HDD operations of FIGS. 1A-1C may be performed manually and/or automatically operated. The HDD tool 14 may be provided with sensors S and a surface unit 38 to collect measurements during the HDD operations. Based on the sensed measurements and/or other data, adjustments may be made to the HDD operations.

While FIGS. 1A-1C shows a three stage service HDD operation, the service operation may involve one or more stages, various combinations of the stages, and/or other tasks. For example, one or more of the service lines 3 may be installed from either location 13, 15. Other HDD operations may also be performed, such as drilling from a first surface location (or entry point), under an obstacle, to remain un-surfaced, where the borehole 12 is lined with perforated pipe, to act as a formation fluid drain (see, e.g., U.S. Pat. No. 5,209,605, previously incorporated by reference herein). Another drilling operation may involve drilling at a first ground surface location (or entry point), under an obstacle and exit at second location into a body of water. See, e.g., U.S. Pat. No. 6,851,490, previously incorporated by reference herein.

Figure 2A:
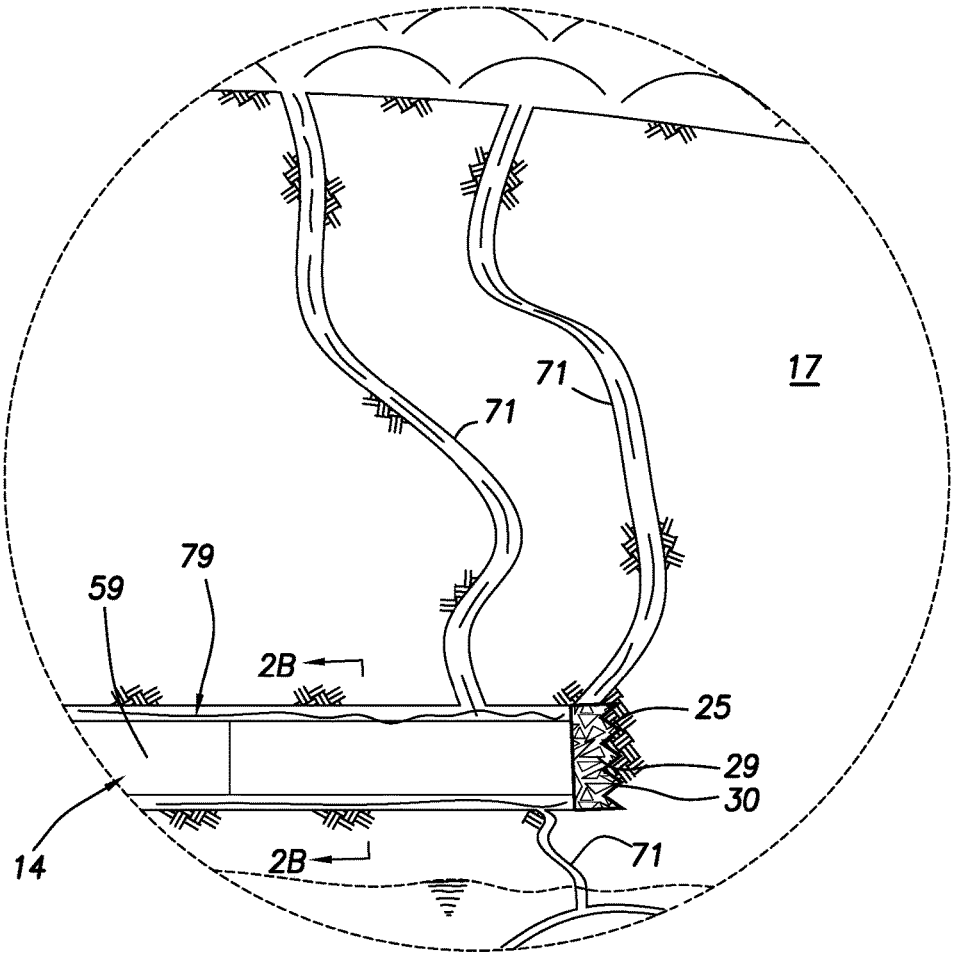
FIG. 2A is a detailed view of a portion of the subsurface formation and the HDD equipment of FIG. 1A depicting borehole damage (BH damage).
Figure 2B:
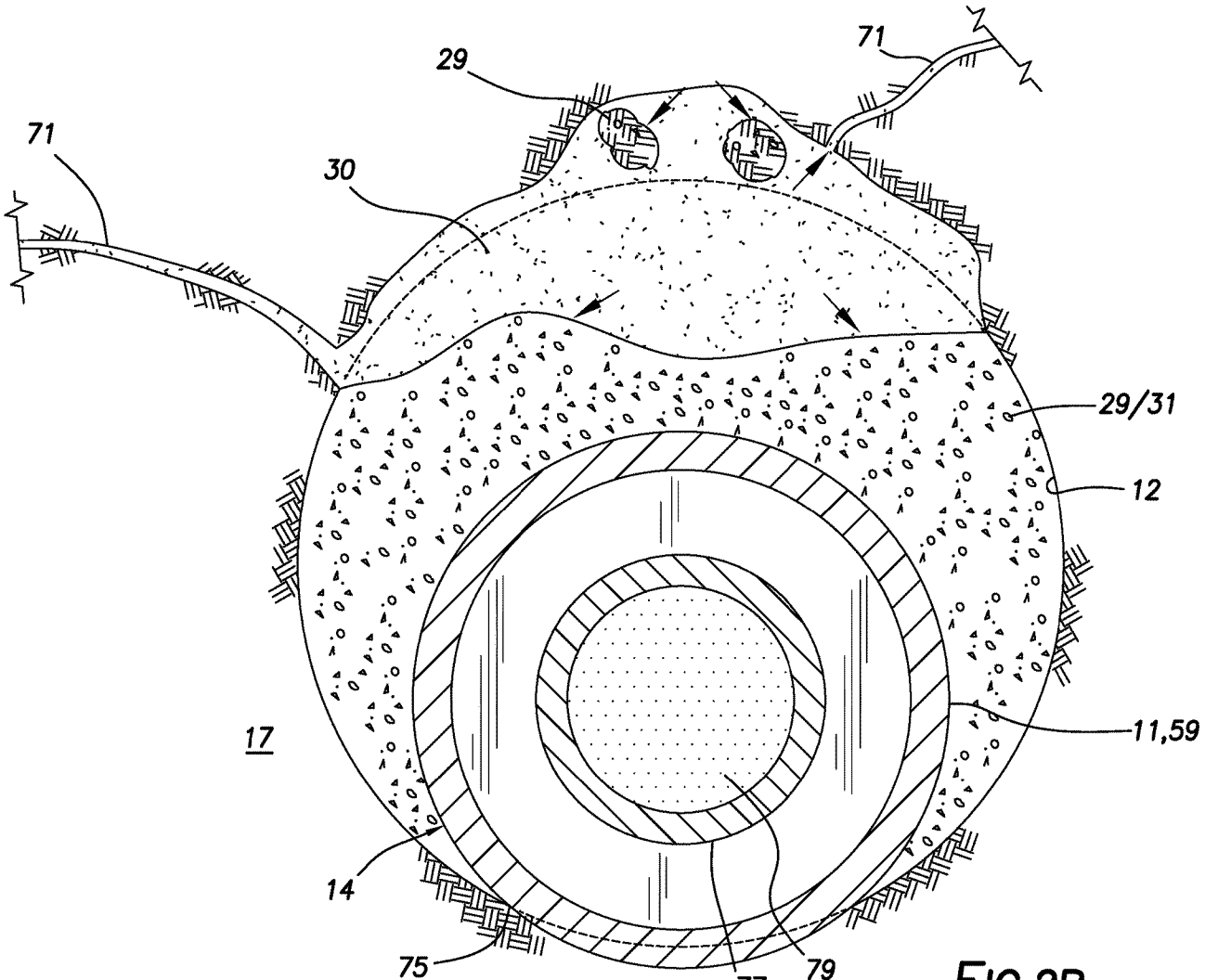
FIG. 2B is a cross-sectional view of the formation of FIG. 2A taken along line 2B-2B.

FIGS. 2A and 2B show the HDD tool 14 operated without return flow therethrough. In some cases, return flow through the HDD tool 14 may be inactivated such that return flow passes through the annulus between the HDD tool 14 and the wall of the borehole 12. FIG. 2A shows the BHA 59 positioned in the borehole 12 with cuttings 29 generated during drilling mixed with drilling fluid 79 to form returns 30. FIG. 2B shows a portion of drilled borehole 12, where cutting 29 settle-out from returns 30. As shown by these figures, during one or more of the various HDD operations, the formation surrounding the borehole 12 may be subject to the BH damage during drilling.

During some drilling conditions, the drilling fluid may pass through the HDD tool 14 and into the borehole 12, and the returns 30 may pass successfully out of the borehole 12, through the HDD tool 14, and back to the surface 23 (FIG. 1A). During other drilling conditions, as shown in FIGS. 2A and 2B, the BH damage, such as frac-out 71, may occur in the formation 17 surrounding the borehole 12. When occurring during the drilling of the borehole 12 as shown in FIG. 1A, this BH damage may be considered an inadvertent loss of returns (e.g., frac-outs). When frac-out occurs during other portions of the HDD operation (e.g., the reaming of FIG. 1B), the BH damage may be considered a cause associated with initial pilot hole drilling frac-outs. For example, higher borehole (annulus) pressures may occur during the pilot hole drilling (e.g., FIG. 1A), which may cause the initial frac-outs and/or weakening of the formation surrounding borehole. This may then lead to further or continuing frac-outs during reaming or pipe installation (e.g., FIGS. 1B and/or 1C).

The BH damage to the formation during drilling may be caused by various non-competent formation conditions. These non-competent formation conditions may involve certain drilling paths, such as horizontal (or near horizontal) and/or shallow subsurface, or weak formations, such as alluvial weak formations (e.g., soft sands, silts, clays, gravels, or fractured rock, and/or other weak materials), may be subject to frac-outs and other BH damage. As the borehole drilling lengthen, the returns annulus pressure-drop increases, and the ability to evacuate the cuttings 29 from the borehole may diminish and pressure in the borehole may increase, thereby increasing potential risk of the returns 30 to frac-out, which may lead to environmental and/or BH damage. Increased returns velocity may require higher pressures (e.g., to achieve turbulent flow) and/or may cause erosion, which may also increase the risk of the frac-out or other BH damage, particularly in the non-competent formations. Erosion may also cause borehole collapse and/or block returns, which may also cause the BH damage. When the drilled fluid returns flow through the borehole annulus at low velocities (e.g., laminar flows), conveyance of solids out of the borehole may be limited, and the entrained solids within laminar flow returns settle-out. This may also reduce the borehole annulus and cause the returns to become turbulent flow, thereby again increasing borehole annulus pressure and the risk of frac-outs, which in turn can damage the formation and the surrounding environment. Where the borehole annulus pressure is higher than the surrounding formation, the differential pressure may result in drag or sticking of the drill string 11 (FIG. 1A). Increased viscosity of drilling mud returns may require greater pressure to force returns throughout the borehole annulus, thereby increasing the risk of frac-outs that may cause damage to the surrounding environment and/or the BH damage.

Also, due to thixotropical nature of drilling mud after prolonged drilling inactivity, static drilling mud returns may gain gel strength and may require greater pump pressure and time to acquire a flowing state, thereby requiring increasing borehole annulus pressure and resulting in the risk of frac-outs that may cause BH damage and/or other environmental damage. Increased drill-mud return velocities across greater diameter portions of the HDD tool, such as drill pipe tool-joints, drill collars, mud motors, stabilizers, BHA subs, etc., may increase annulus pressure, induce differential sticking of the HDD tools, and/or promote frac-outs, which may lead to the environmental damage and/or the BH damage. Vibration of the HDD tool (e.g., the Positive Displacement mud Motor (PDM)) may cause erosion (e.g., soil liquefaction) along the borehole, thereby effecting BHA stability and/or returns flows which may result in the BH damage. Some BH damage, such as excessive undulations and/or dog-legs that may cause severe tortuosities, that may also make it difficult or impossible to install the infrastructure line, or damage to the infrastructure line and/or its protective coatings.

As also shown by FIGS. 2A and 2B, the HDD tool 14 may be operated with return flow activated (FIG. 3A-4) or inactivated/conventional mode (FIGS. 2A-2B). In some cases, return flow may be inactivated and/or blocked, while the drilling fluid 79 passes through the inner pipe 77 and into the borehole 12. This operation may be similar to conventional drilling where the returns 30 may settle solids 31 in the borehole 12 as shown. In this example, the drilling fluid does not return uphole between the inner pipe 77 and the outer pipe 75. Instead, the drilling fluid 79 passes outside of the outer pipe 75 and into the borehole 12 where it may settle out.

Figure 3A:
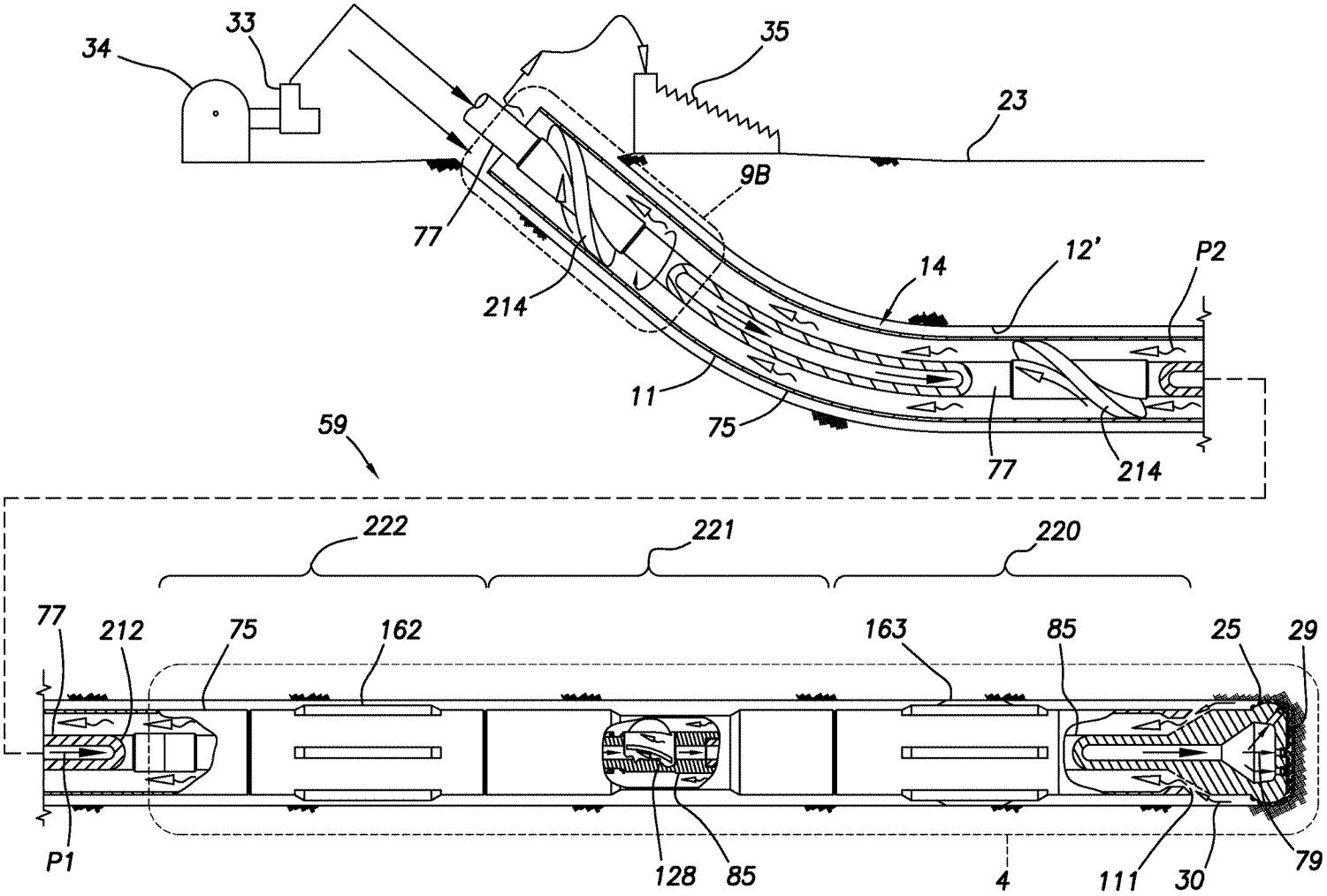
FIGS. 3A and 3B are schematic diagrams, partially in cross-section of an example of the HDD tool with return flow capability.
Figure 3B:
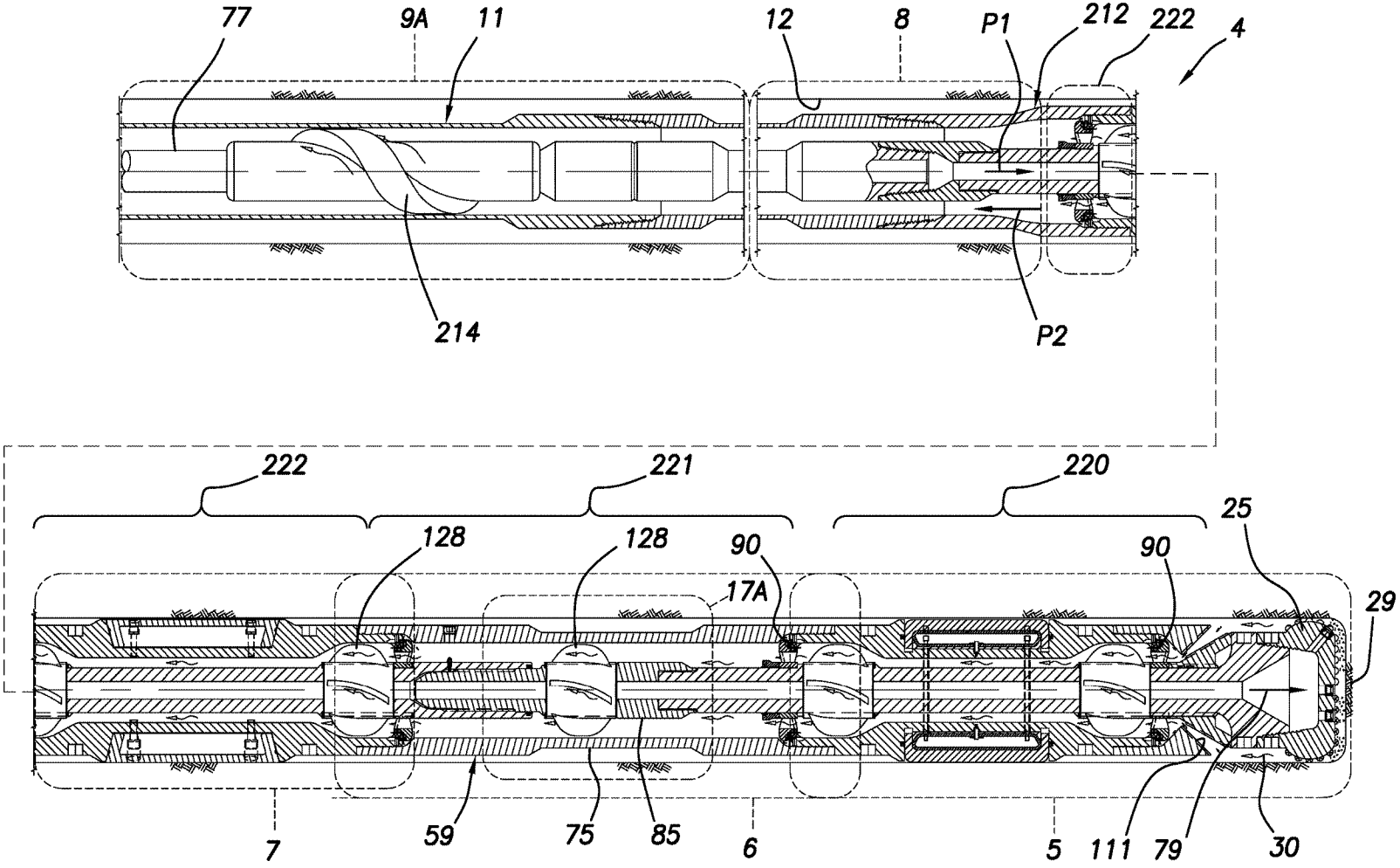
Figure 4:
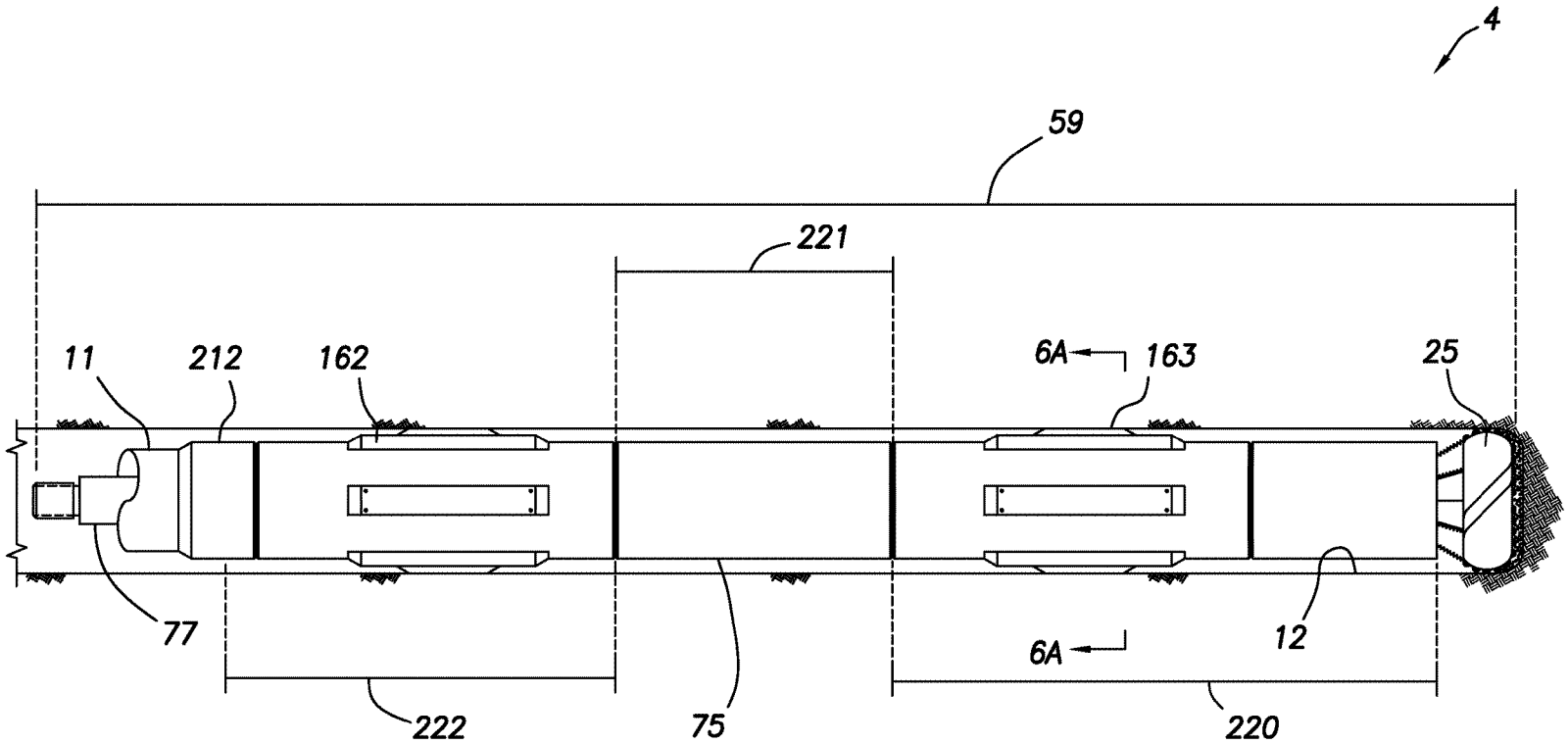
FIG. 4 is a schematic diagram depicting a portion 4 of the HDD tool of FIG. 3A.

FIGS. 3A-3B and 4 depict various views of the HDD tool 14 with return flow capabilities usable for performing the HDD operations of FIGS. 1A-1C. As shown by these views, the HDD tool 14 is supported by the rig 33, and includes the bit 25, the BHA 59, and the drill string 11. The bit 25 is at a distal end of the BHA 59. The bit 25 may be a conventional drag, roller cone, and/or sloped planar jet bit 25 advanced and rotated to cut away portions of the formation (i.e., cuttings 29) and form the borehole 12.

The drill string 11 extends from the rig 33 to the BHA 59 and includes inner pipes 77 and outer pipes 75 threadedly connected in series by the rig 33 to form a tubular drill string 11. The inner pipes 77 and outer pipes 75 are axially and/or rotatably drivable by the rig 33. As indicated by the arrows, the inner pipes 77 and outer pipes 75 may be independently or integrally coupled to the rig 33 for simultaneous or independent operation such that the inner and outer pipes 77, 75 are rotated and/or advance/retracted in the borehole 12 as desired. Examples of rigs and/or drivers that may be used are described in U.S. Pat. No. 6,827,158 and 2013/0068490. The BHA, pipes, and/or other portions of the HDD tool 14 may be made of a lightweight materials, such 6000 Series Aluminum Alloy and/or Titanium Alloy.

The inner pipes 77 and the outer pipes 75 define concentric passages P1, P2 for flow of fluid therethrough. Fluid from the mud pump 34 may pass along passage P1 through the inner pipes 77 and the BHA 59 to bit 25. The returns 30 from the borehole 12 may pass along passage P2 between the inner pipes 77 and the outer pipes 75 back to the surface 23. The drilling fluid 79 passing through the HDD tool 14 mixes and entrains with the cuttings 29 to form the returns 30 that may be pumped through the HDD tool 14 and back to the surface 23 for processing through the solids control 35. The advancement (e.g., axial and/or rotational driving) of the HDD tool 14 may be selectively controlled. For example, the advancement may at a ratio between a drilling rate of the advancing drill-string and a drilling fluid pumping rate of the passing the drilling fluid through inner pipe 77.

The BHA 59 is supported between the bit 25 and the drill string 11. As shown FIG. 3A, the BHA 59 comprises distal housing 220 at a distal end of the BHA 59, proximal housing 222 at a proximal end of the BHA, and a coupling housing 221 therebetween. The housings 220-222 may be tubular housings threadedly connectable to each other and to the outer pipes 75 of the drill string 11. The housings 220-22 may be coupled to and operate as part of the outer pipe 75, collectively referred to as an outer tube.

Each of the housings 220-222 may be provided with stabilizers 162, 163 on an outer surface thereof for engagement with a wall of the borehole 12. The stabilizers 162, 163 may include adjustable steering stabilizers and/or fixed stabilizers as is described further herein. The proximal housing 222 externally includes fixed stabilizers 162 and the distal housing 220 externally includes adjustable stabilizers 163. The BHA 59 may also have interior components, such as a tubular shaft 85, propulsors 128, and other BHA components.

The tubular shaft 85 may include one or more tubular shafts (e.g., drive shafts) extending through the housings 220-222 between the drill string 11 and the bit 25. A proximal end of the tubular shaft 85 may be connectable to a distal end of the inner pipe 77 of the drill string 11 for fluid communication therebetween and rotation therewith. The tubular shaft 85 may be coupled to and operate as part of the inner pipe 77 of the HDD tool 14, collectively referred to as an inner tube. An X-over adaptor 212 may also be provided to connect the distal housing 220 to outer pipe 75 of the drill string 11, and a distal end of the tubular shaft 85 to the inner pipe 77 of the drill string 11. The bit 25 may be connected to the inner pipe 77 via tubular shaft 85 at the distal end of the distal housing 220 for fluid communication therebetween and rotation therewith.

The propulsors 128 may be positioned along an outer surface of the tubular shaft 85 and extend into the passage P2 between the tubular shaft 85 and the housings 220-222. The propulsors 128 may be blades attached to an outer surface of the tubular shaft 85, or be integral with tubular portions connectable to the tubular shaft 85. One or more of the propulsors 128 may be connected to or part of the inner pipes 77 of the drill string 11 and/or the tubular shaft 85 of the BHA 59. The propulsors 128 may be fixed to the tubular shaft 85 and rotate therewith. Such rotation may be used to agitate the entrained bit cuttings 29 of returns 30 as they are urged through a path of the passage P2 in the housings 220-222. A pipe protector 214 may also be provided along the inner pipe 77 with blades rotatable with the inner pipe 77 to further facilitate flow, and/or to support the inner pipe 77 within the outer pipe 75.

The BHA 59 may be provided with a variety of the interior components for performing various operations, such as a motor to drive the propulsors 128, the tubular shaft 85, and/or the bit 25. The BHA 59 may also be provided with interior components for performing various functions, such as sensing, measurement, survey, drilling, power, communication, etc. (see, e.g., sensors S of FIG. 1A).

Fluid circulation is defined along paths extending through the passages P1 and P2 through the HDD tool 14 as indicated by the arrows. The fluid circulation includes a drilling fluid path in passage P1 extending through the HDD tool 14, and a fluid returns pathway P2 extending back through the drill string 11. The passage P1 of the inner pipe 77 of the drill string 11 may extend through the inner pipe 77 and the bit 25 for passage of the drilling fluid 79 through the BHA 59 and out the bit 25. The mud pump 34 may pump drilling fluid 79 through rotatable inner pipe 77 of the drill string 11, through the BHA 59, and out the bit 25. The drilling fluid 79 may pass into the borehole 12 to mix and entrained with the cuttings 29 to form the returns 30.

The returns 30 from borehole 12 may pass back into the HDD tool 14 from inlet 111 behind distal end of shaft 85, pass through passage P2 extending between the tubular shaft 85 and the housings (or BHA sections) 220-222, and between the inner pipes 77 and the outer pipes 75. The returns 30 may be urged through passage P2 by rotation of rotational drivers, such as the propulsors 128, helical pipe protectors 214, and supports 90 (including inner bearing races 96 as described further herein with respect to at FIGS. 18A-19C). The returns 30 may exit the HDD tool 14 at the surface 23 and be passed to the solids control 35 located on the surface 23 for cleaning and reuse.

Figure 5A:
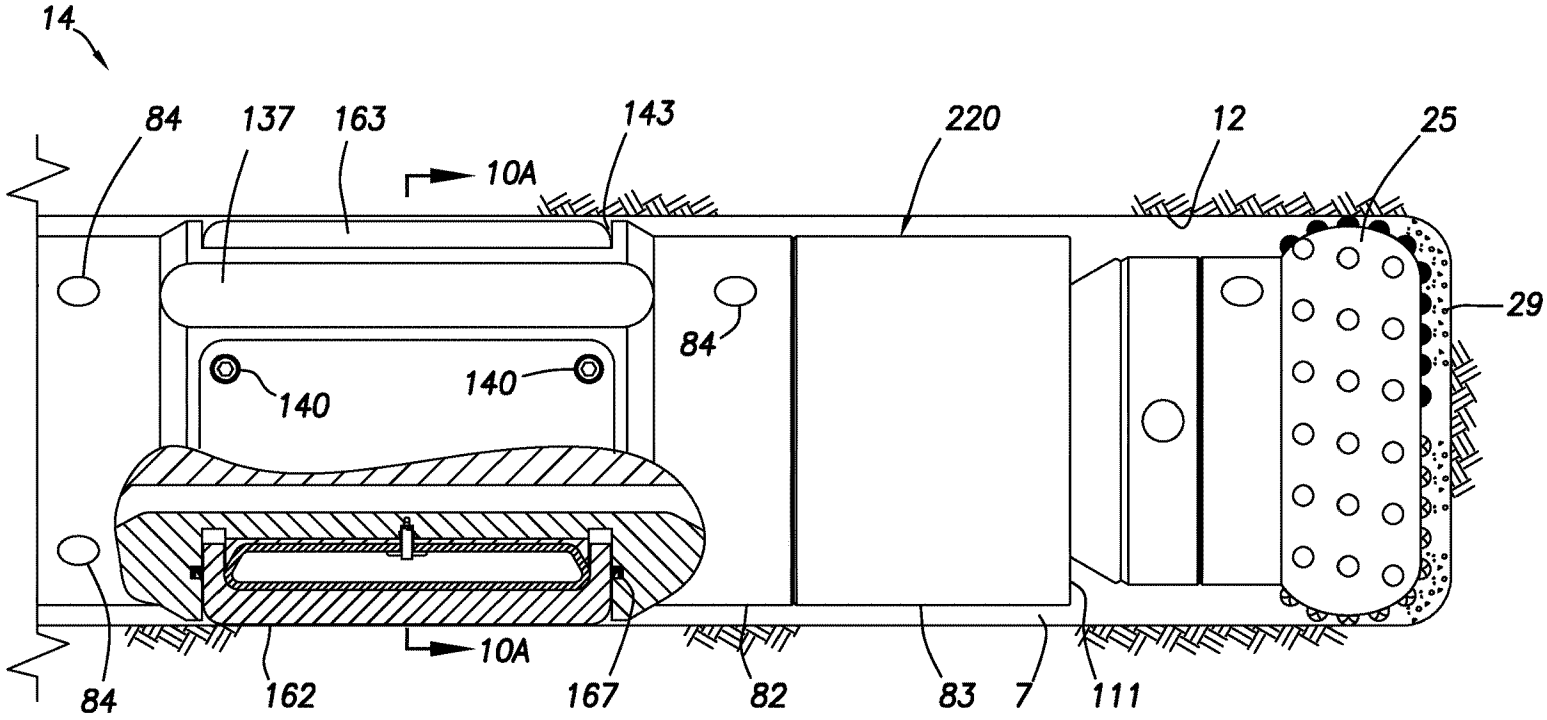
FIGS. 5A and 5B are partial, cross-sectional views of a portion 5 of the HDD tool of FIG. 3B.
Figure 5B:
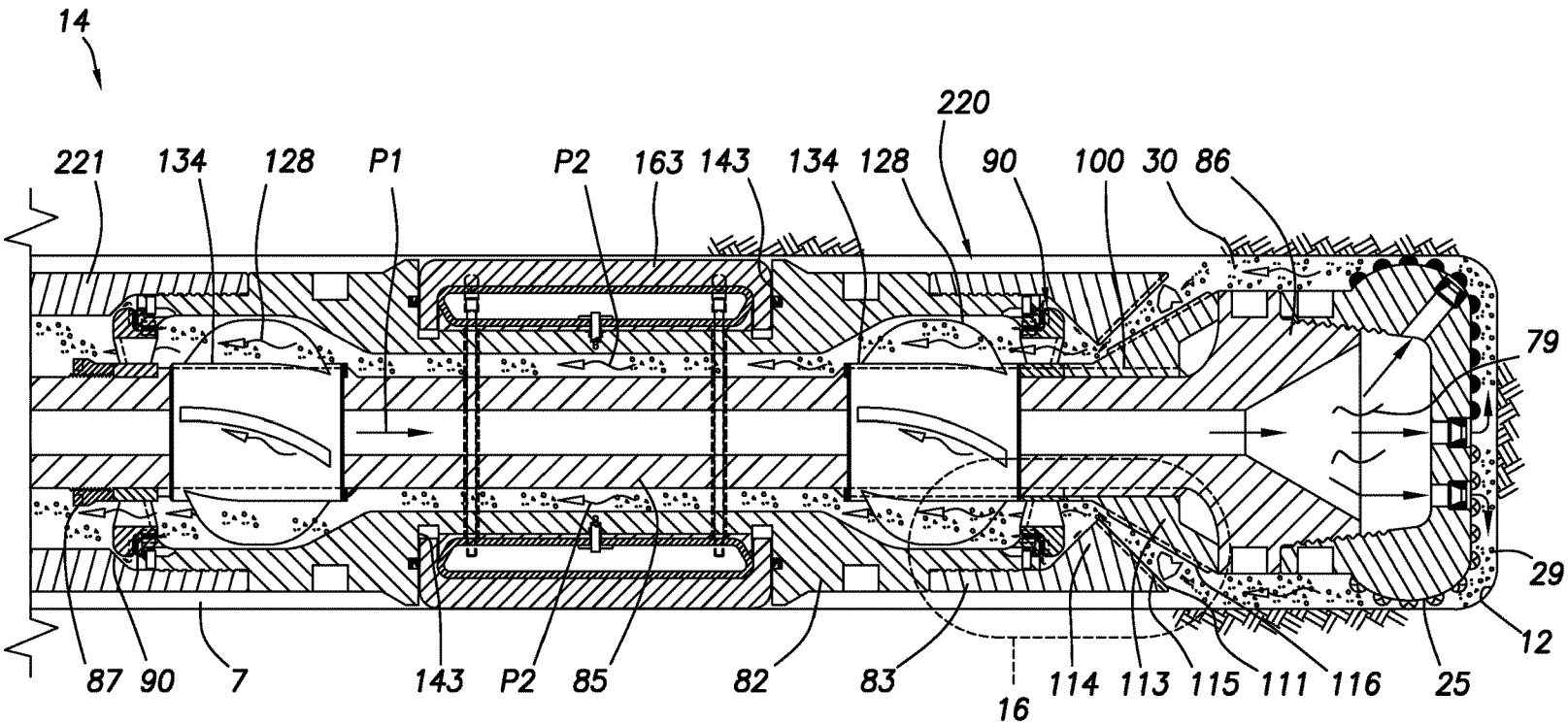

FIGS. 5A and 5B depict various views of a distal end of the HDD tool 14 including the distal housing 220 and the bit 25. As shown in these views, the distal housing 220 may be a bearing and stabilizer housing for supporting the bit 25 and the stabilizers 162, 163 for engagement with the wall of the borehole 12. The bit 25 extends from a distal end of the distal housing 220. The stabilizers 162, 163 are positioned radially about an exterior surface of the distal housing 220.

The distal housing 220 includes a cone housing 83 and a stabilizer housing 82. The cone housing 83 is threadedly connected to the distal end of the stabilizer housing 82. A proximal end of the bit 25 is coupled to the tubular shaft 85 for fluid communication and rotation therewith. The drill bit 25 and the tubular shaft 85 may be rotatably supported within the distal housing 220 and independently movable therein. The tubular shaft 85 has an inner cone 113 with an outer cone 114 at a distal end of the cone housing 83. The outer cone 114 has an abrasive angled surface 115 positioned opposite an abrasive angled surface 116 of the inner cone 113 defining a funnel shaped opening that defines a returns 30 inlet 111 therebetween (see, e.g., FIG. 16). The shaft 85 may be provided with an upset 86 for connection with the inner cone 113. The bit 25 is threadedly connected to the distal end of the upset 86, and the inner cone 113 is butted against or fastened to a proximal side of the upset 86 of the tubular shaft 85. The cone housing 83 is rotatably fixed to the distal end of the stabilizer housing 82.

The bit 25 has passages therethrough for passing the drilling fluid 79 from the tubular shaft 85 and through the bit 25 along the path in passage P1 as indicated by the arrows. The drilling fluid 79 exiting the bit 25 mixes and entrains with cuttings 29 from the formation to form the returns 30. As shown, the bit 25 is depicted as a fixed cutter bit, but could be any type of bit capable of cutting away portions of the formation to form the borehole 12.

The inlet 111 is positioned uphole from the bit 25 to receive the returns 30 as they are generated during drilling. The inlet 111 is in fluid communication with the path of the passage P2 for passing the returns 30 uphole through the HDD tool 14 during drilling. The inlet 111 is, in part, defined by the inner cone 113, which is rotatably attached by splines 100 (e.g., fluid filled splines) to a distal end of the shaft 85. The splines 100 form spline connections between the shaft 85 and the inner cone 113. The inlet 111 is positioned between the inner cone 113 and the outer cone 114, and the inlet 111 is tapered between the angled surfaces 115, 116 to define a returns grinder to grindingly receive the returns as the inner cone 113 and outer cone 114 rotate. The inlet 111 may be sized and/or shaped to receive returns with a maximum size solids, and/or to reduce the size of such solids to pass into the passage P2.

The stabilizer housing 82 is threadedly connected to coupling housing 221. The exterior surface of the stabilizer housing 82 is shaped to pass into the borehole 12 created by the bit 25 with an annulus 17 defined therebetween. The exterior surface may have depressions, such as relief slots 137, extending therein. These depressions may be used to provide pathways for fluid flow and/or to provide a reduced surface area for contact (or sticking) with the wall of the borehole 12. The stabilizer housing 82 may also have connectors, such as bolts 140, for selectively connecting the stabilizer housing 82 and/or its components, and access holes 84 extending into the stabilizer housing 82. The access holes 84 may be, for example, spanner wrench holes disposed through the distal housing 220 for convenience of tightening or loosening threaded connections during repair or maintenance.

The stabilizer housing 82 may also have stabilizer pockets 143 extending into the exterior surface. The stabilizer pockets 143 may be shaped to operatively receive the stabilizers 162, 163. The stabilizers 162, 163 in this example include fixed stabilizers 162 positioned within the stabilizer pockets, and adjustable stabilizers 163 extendable therefrom. The stabilizers 162, 163, and/or pockets 143, may be provided with seals 167 to prevent solids laden fluid flow into the stabilizer pockets 143. The stabilizers 163 may be positioned for engagement with the wall of the borehole 12. Further details concerning the stabilizers are described more fully herein with respect to FIGS. 10A-15B.

The stabilizer housing 82 has an inner surface shaped to support the tubular shaft 85 and other internal components of the HDD tool 14 therein. In this example, the stabilizer housing 82 has an inner surface shaped to receivingly support the tubular shaft 85 therein. The supports 90 are positioned between the stabilizer housing 82 and the tubular shaft 85 to define the path along the passage P2 therebetween. The size of the supports 90 may be shaped to define the dimensions of the path of the passage P2 to permit a volume of fluid flow therethrough. Examples of supports in the form of bearing races are described further herein with respect to FIGS. 16-19C.

The propulsors 128 may be positioned radially about the tubular shaft 85 and rotatably supported thereon by splines 134. The propulsors 128 may be rotatable within the distal housing 220 to urge flow of the returns 30 towards the surface. The returns 30 are urged into the inlet 111 and uphole through the distal housing 220 by drawing the returns 30 from the borehole 12 through the inlet 111. The inlet 111 may be shaped to reduce oversized drilled solids that may be entrained within returns 30 and/or to assure the solids in the returns 30 may be conveyed throughout the path of the passage P2 without blocking any passageways. As the returns 30 pass through the path of the passage P2, the returns 30 may provide cooling and lubrication for portions of the HDD tool 14, such as the supports 90.

Figure 6:
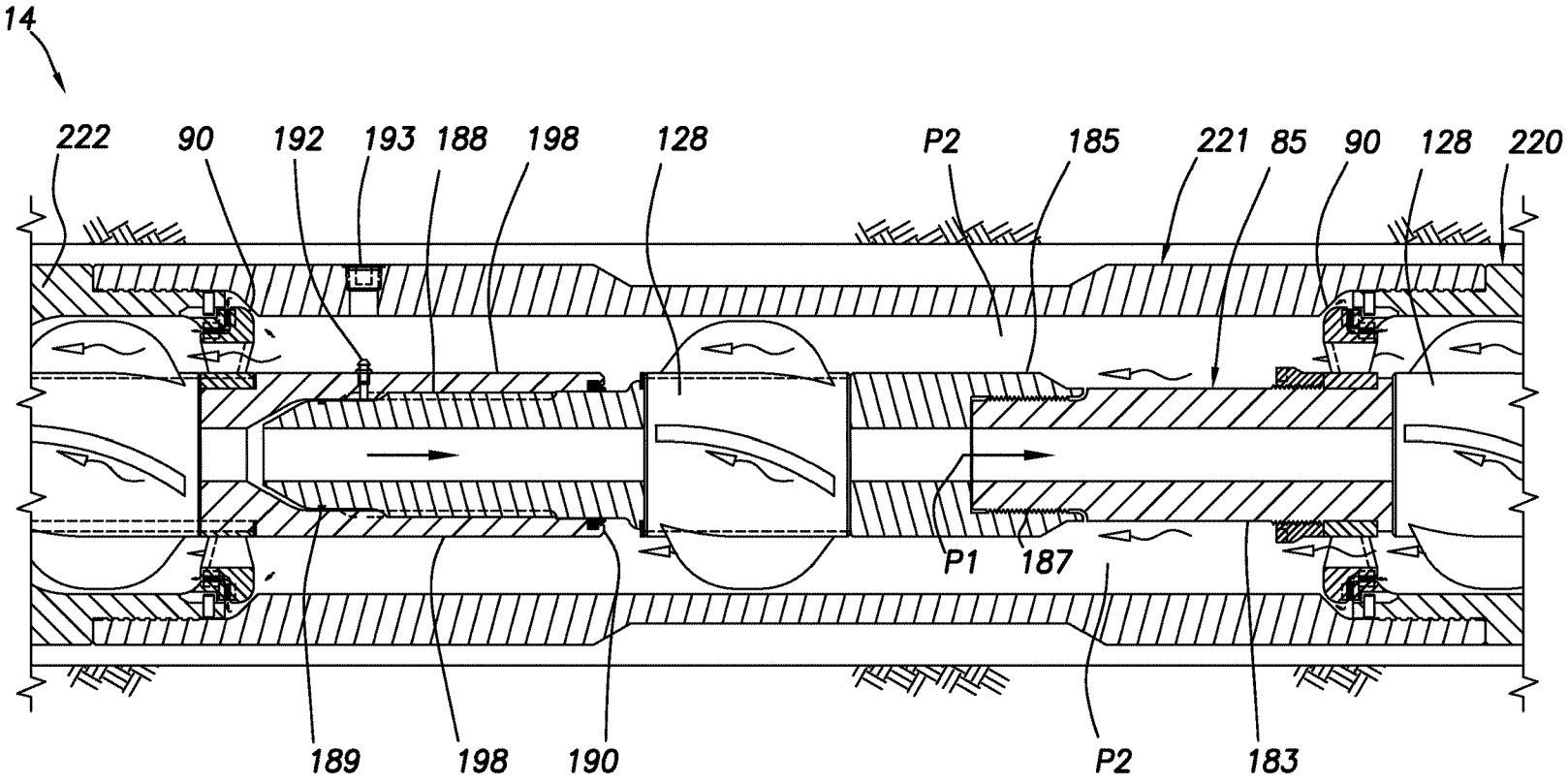
FIG. 6 is a longitudinal, cross-sectional view of a portion 6 of the HDD tool of FIG. 3B.

FIG. 6 shows a detailed view of the coupling housing 221 (portion 6 of FIG. 3B). As shown in this view, the coupling housing 221 is a unitary piece threadedly connected between the distal housing 220 and to the proximal housing 222. The coupling housing 221 may be provided with features, such as access plug 193 extending through an outer surface thereof. The access plug 193 may provide an inlet into the interior of the coupling housing 221. The supports 90 may also be provided in the coupling housing 221 for supporting the tubular shaft 85 therein with the passage P2 defined therebetween. The coupling housing 221 may also be provided with various shapes as needed for manufacturing and/or operational purposes. As shown in this version, the coupling housing 221 has a tapered outer surface and a smooth inner surface. The outer surface has a larger diameter at each end and a narrower diameter therebetween. The inner surface has a constant diameter capable of receiving the tubular shaft 85 and other components.

The tubular shaft 85 within the coupling housing 221 includes a series of shaft portions 183, 185, 198 threadedly and matingly connected together with the path in the passage P1 extending therethrough. The shaft portion 183 is spline connected to the propulsor 128 in the distal housing 220, and threadedly connected to the shaft portion 185 within the coupling housing 221. The shaft portion 185 has a propulsor 128 integrally or removably connected thereto. The shaft portion 185 is connected between the shaft portions 183 and 198 for rotation therewith. The propulsor 128 along the coupling housing 221 urge the returns 30 uphole through the coupling housing 221 through the path of the passage P2.

Various components, such as seals 189, 190, connections (e.g., spline 188, thread 187), grease zerk fitting 192, connection means, and/or other features, may be provided as shown. The seals 189, 190 may be used to prevent flow of fluid from entering the connection at splines 188, and/or as a relief passageway for trapped and/or pressurized lubrication between the shaft portions 183, 185 and 198. The connections along the splines 188 may be lubricated by way of grease zerk fitting 192 through an access hole to the removable access plug 193. The shaft portions 183, 185, 198 (and other items connected along portions of the HDD tool 14) may be provided with various connection means, such as the threads 187 and the splines 188. For example, the shaft portion 198 may have an inlet with splines 188 matably connected to the shaft portion 185 for translating rotation therebetween. The splines 188 may allow for thermal expansion or contraction of the shaft portions 183, 185, 198. In another example, threads 187 may be provided between shaft portions 185 and 183 for connection and translation of rotation therebetween.

Figure 7:
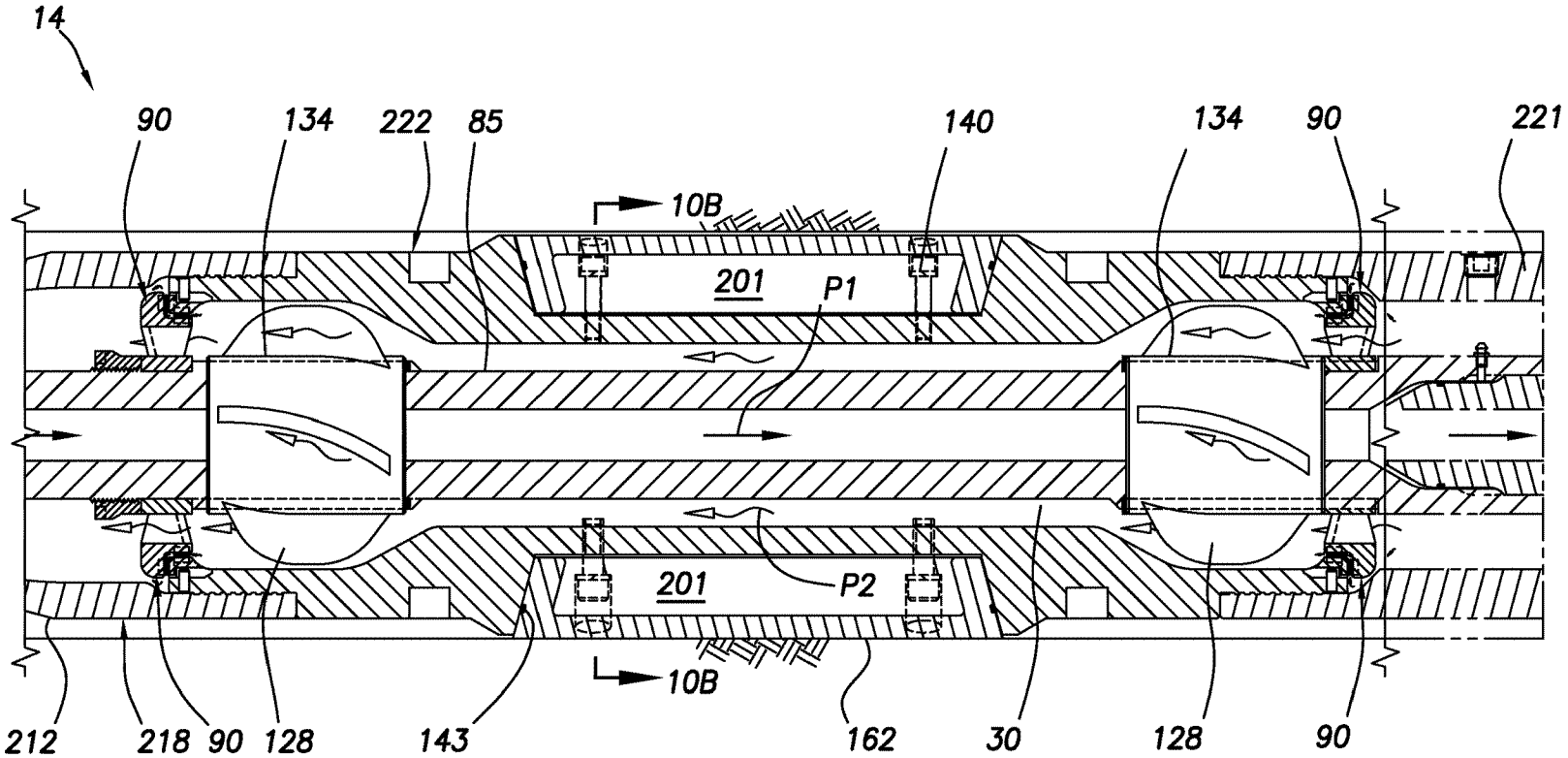
FIG. 7 is a longitudinal, cross-sectional view of a portion 7 of the HDD tool of FIG. 3B.

FIG. 7 shows a detailed view of the portion 7 of FIG. 3B depicting the proximal housing 222. As shown in this example, the proximal housing 222 may be a stabilizer housing including a tubular housing threadedly connected between the coupling housing 221 and the X-over adapter 212. This proximal housing 222 has fixed stabilizers 162 bolted into the stabilizer pockets 143 of the proximal housing 222 with bolts 140. The proximal housing 221 has an outer diameter that increases about the fixed stabilizers 162. The fixed stabilizers 162 may have a larger diameter for engagement with the wall of the borehole 12. The fixed stabilizers 162 may also have a cavity 201 therein for hosting electronics and/or other devices.

The proximal housing 222 has a tapered inner surface with larger diameters at each end and a narrow diameter therebetween. The smaller diameter is shaped to receive the tubular shaft 85 and the larger diameter is shaped to receive the propulsors 128. The propulsors 128 are connected to the tubular shaft 85 by the splines 134 for rotation therewith. The tubular shaft 85 is rotationally supported within the proximal housing 222 by the supports 90 with the path of the passage P2 defined therebetween. This portion of the tubular shaft 85 may be a unitary piece with the path through the passage P1 extending therethrough. The returns 30 passing through P2 are urged further uphole through proximal housing 222 by rotation of the propulsors 128.

Figure 8:
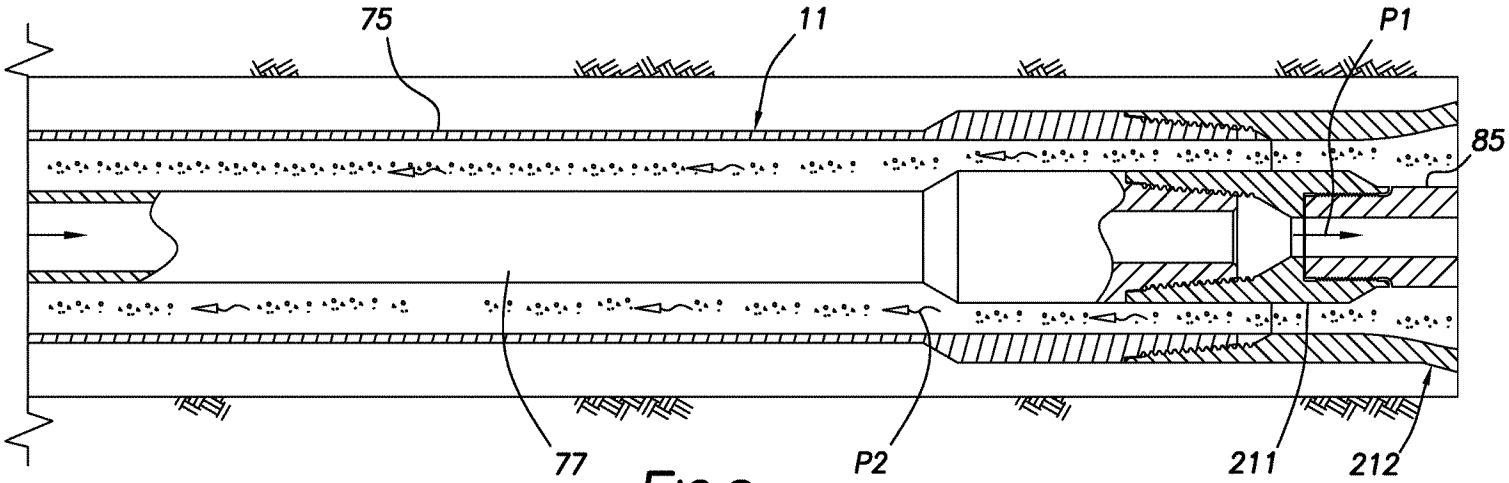
FIG. 8 is a longitudinal, cross-sectional view of a portion 8 of the HDD tool of FIG. 3B.

FIG. 8 shows a detailed view of the portion 8 of FIG. 3B depicting the X-over adapter 212 and a portion of the dual drill string 11. This view shows the outer pipe 75 with the inner pipe 77 of drill string 11 concentrically positioned adjacent the X-over adapter 212 with the paths of the passages P1, P2 extending thereabout as shown. The X-over adaptor 212 is threadedly connected between the outer pipe 75 and the proximal housing 222. The inner pipe 77 and the tubular shaft 85 each have a constant diameter which expands at a distal end for connection to the X-over inner sub 211. The X-over inner sub 211 and X-over adaptor 212 may be connected with the dual drill string 11 and the proximal housing 196 to provide rotation and torque to the propulsors 128 and the drill bit 25.

Figure 9A:
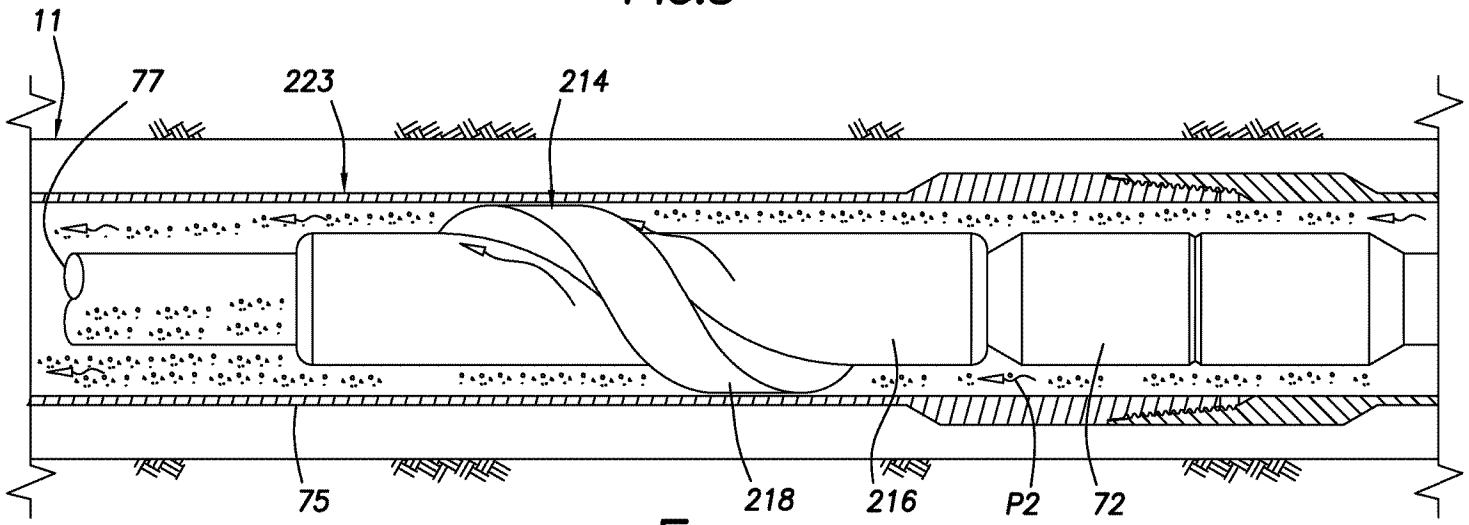
FIGS. 9A and 9B are partial, cross-sectional views of portions 9A and 9B of the HDD tool of FIGS. 3B and 3A, respectively.
Figure 9B:
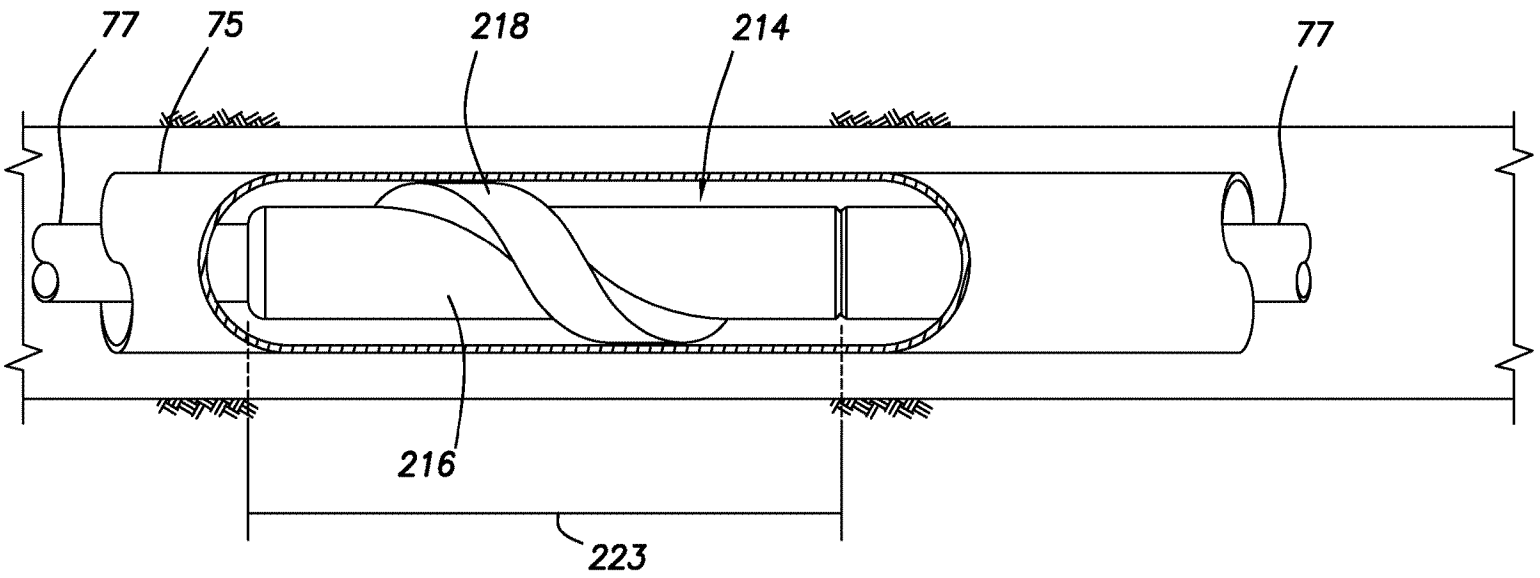

FIGS. 9A and 9B show views of a helical flow-assist pipe protector 214 that may be provided along a portion 223 of the dual drill string 11 (see, e.g., portion 9A of FIG. 3B). One or more pipe protectors 214 may be threadedly or stretched connected along one or more portions of the HDD tool 14. The pipe protectors 214 may be axially spaced along the inner pipe 77 (e.g., one for each inner pipe 77 joint).

The pipe protector 214 may include a tubular member 216 and a helical blade 218. The tubular member 216 may be a cylindrical member having a passage therethrough in fluid communication with the tubular shaft 85 to allow fluid to continue along the path of the passage P1. The tubular member 216 may have a diameter larger than the tubular shaft 85. One or more threaded connectors, such as tool joint 72 may optionally be provided for connection to the inner pipe 77.

The helical blade 218 extends radially from the tubular member 216. The helical blade 218 may be made of a flexible material, such as rubber or rubber like material. The helical blade 218 may rotate with the inner pipe 77 during drilling to further urge returns 30 along path of the passage P2 between the inner pipe 77 and the outer pipe 75. The pipe protectors 214 may act as a flow-assist helical pipe protector for urging returns flow, agitating laminar returns flow, keeping solids in flow suspension, and/or acting as a marine bearing. The pipe protectors 214 may also be used to prevent wear along the dual drill string 11, such as outside wear of the inner pipe 77 and inside wear of the outer pipe 75 which may be due to differential rotation therebetween.

FIGS. 10A-15B shows various configurations of stabilizers usable with the HDD tool 14 of FIG. 3B. As shown by these views, one or more various stabilizers may be used in the HDD tool 14. While each example depicts four stabilizers, it will be appreciated that the drilling tool 14 may be provided with one or more stabilizers positioned radially about various portions of the HDD tool 14. Also, while the fixed stabilizers are depicted as rectangular, fixed (and/or) stabilizers may have various shapes, such as a spiral shape. The stabilizers may be configured for various purposes, such as to provide contact with the borehole wall, to alter the bottom hole assembly (BHA) drilling direction, to follow a predetermined and/or desired borehole path, etc.

Figure 10A:
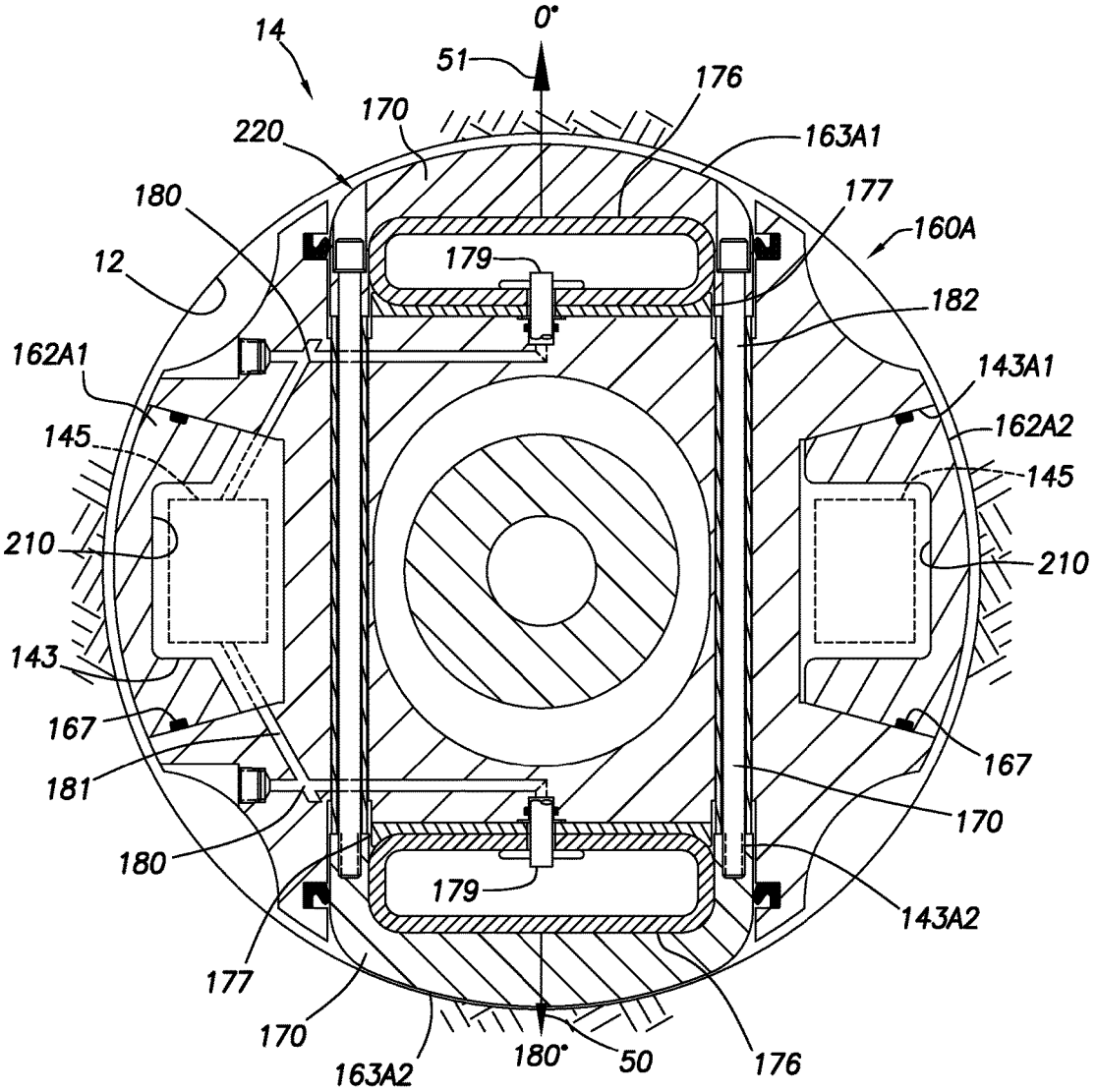
FIG. 10A is a radial, cross-sectional view of the portion of the HDD tool of FIG. 5A taken along line 10A-10A.
Figure 10B:
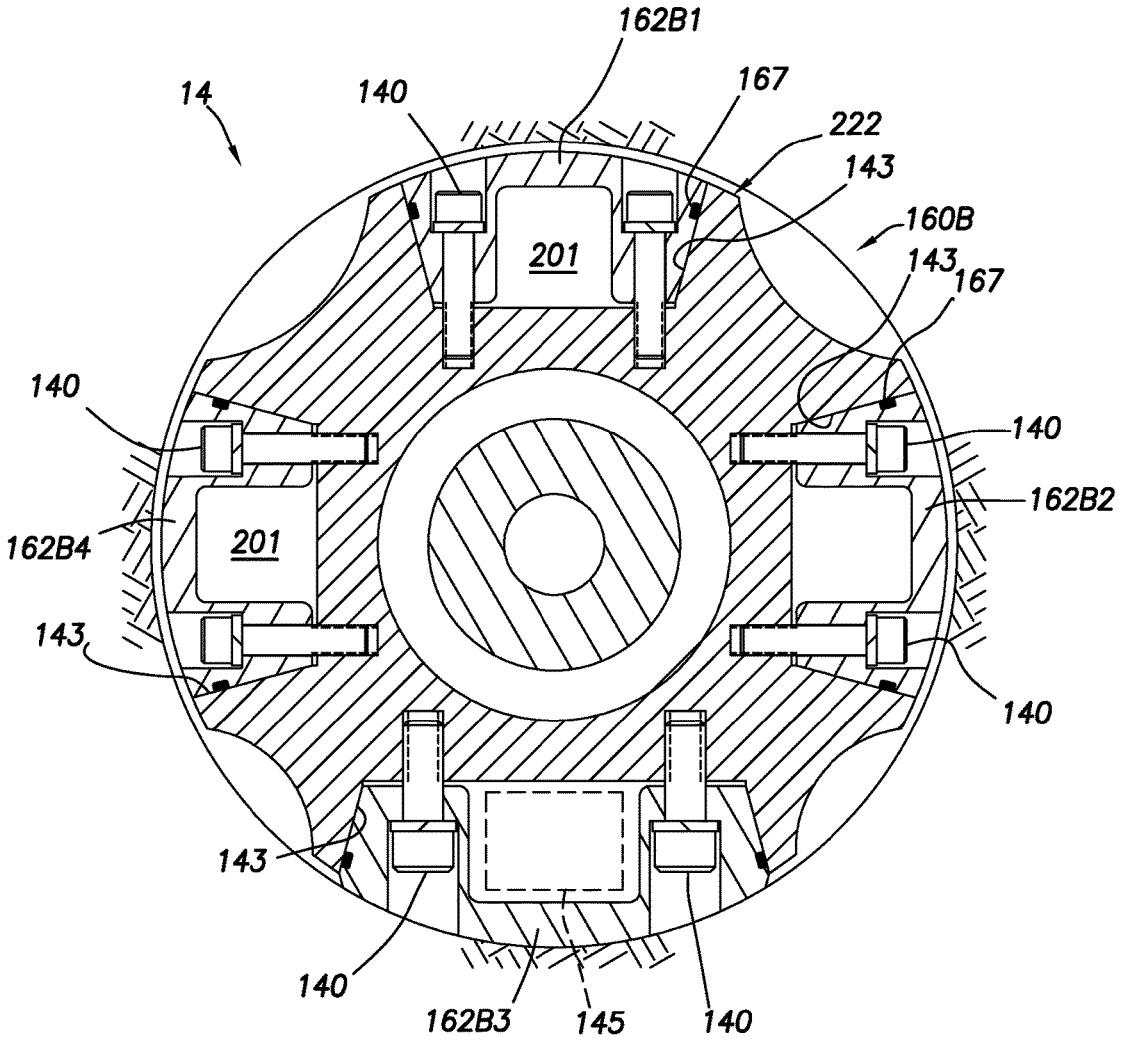
FIG. 10B is a radial cross-sectional view of the portion of the HDD tool of FIG. 7 taken along line 10B-10B.

FIGS. 10A and 10B show radial cross-sectional views of the HDD tool 14 of FIGS. 5A and 7 taken along lines 10A-10A and 10B-10B, respectively. FIG. 10A shows an example of the HDD tool 14 with double-acting adjustable stabilizer (DAS) 160A. The DAS 160A includes a pair of fixed stabilizers 162A1, A2 and a pair of adjustable stabilizers 163A1, A2 usable as the stabilizers 162,163 of FIGS. 5A and 5B. The stabilizers 162A1,A2, 163A1,A2 are positioned in the pockets 143 of the distal housing 220, with the stabilizers 162A1,A2, 163A1,A2 on opposite sides of the distal housing 220.

The fixed stabilizers 162A1,A2 are non-adjustable low stabilizer/enclosure stabilizers fixed to the distal housing 220. The fixed stabilizers 162A1,A2 may be used to provide drilling stabilization to the HDD tool 14. The fixed stabilizers 162A1,A2 may extend a radial distance beyond the distal housing 220 for engagement with the wall of the borehole 12. The fixed stabilizers 162A1,A2 may act as centralizers and/or wear resisters of HDD tool 14 during operation.

The fixed stabilizers 162A1,A2 may also be used to house components beneath an outer surface of the HDD tool 14. The fixed stabilizers 162A1,A2 may have the cavities 210 therein for hosting various types of components 145. The components 145 may be secured within the cavities 210 and sealed therein by seals 167. The components 145 may be, for example electrical components (e.g., a battery pack, sensors, controllers etc.) which may be used to supply electrical needs to components in the HDD tool 14 and/or hydraulic components (e.g., a hydraulic pump, electric motor, valving and controllers) which may supply hydraulic fluid and/or pressure to the HDD tool 14. As shown in the example of FIG. 10A, the hydraulic components 145 may be used to provide flow and pressures to operate the adjustable stabilizers 163A1, A2.

The pair of adjustable stabilizers 163A1,A2 may be physically identical and linked to produce, in an individual manner, the same radially extending applied force to the wall of the borehole 12, to bias the distal housing 220 to the opposite wall of borehole 12. The adjustable stabilizer/s 163 may be selectively activated from a surface location (e.g., rig 33) to generate radial force against the wall of the borehole 12 and orient the HDD tool 14. The adjustable stabilizers 163A1,A2 are movably positioned in pockets 143 for extension and retraction about the HDD tool 14. The stabilizers 163A1,A2 are radially slidably within their respective pockets 143 which are circumferentially 180 degrees set-apart (arrows 50, 51) about the exterior of the distal housing 220.

The adjustable stabilizers 163A1, A2 have pressurized (e.g., inflatable) bladders 176 therein movably supported on a bladder backing plates 177. The bladders 176 each have a bladder valve stem 179 that protrudes through the backing plates 177. The bladder valve stems 179 fluidly connect the bladders 176 to fluid passageways 180 disposed within distal stabilizer housing 82. The component 145 may be a hydraulic fluid power source located within fixed stabilizer 162A1, from where hydraulic fluid volume may be alternatively conveyed through passageways 180 to either of the adjustable stabilizers 163A1,A2. This fluid may be used to supply hydraulic flows and pressures through fluid passageways 181 to or from bladders 176 of the adjustable stabilizers 163A1 and 163A2. The bladders 176 may be activated remotely at the surface, for example, by commands from a ground surface driller, The stabilizers 163A1,A2 are movably connected to the distal stabilizer housing 82 by steering shoes 170 and draw bolts 182. As an example, by pressurizing bladder 176, steering shoe 170 of adjustable stabilizer 163A2 radially extends by applying force against the wall of the borehole 12 as indicated by arrow 50. This force also retracts steering shoe 170 of adjustable stabilizer 163A1 along drawbolts 182 thereby extending a borehole clearance between the distal housing 220 and the wall of the borehole 12. The force 50 also provides a reactive force as indicated by arrow 51 for the distal housing 220 to freely bias drilling oppositely from the wall of the borehole 12 about arrow 50. The fluid flow and pressures into and out of the bladders 176 may be used to selectively manipulate the position of the stabilizers 163A1,A2 and thereby the distal housing 220 as needed as is described further herein.

FIG. 10B is a cross-sectional view of the proximal housing 222 taken along line 10B-10B of FIG. 7. This figure shows an example of two pairs of fixed stabilizers 162B1-B4 bolted by bolts 140 to the proximal housing 222. In this example, the fixed stabilizers 162B1-B4 are in non-adjustable Upper Stabilizer/Enclosures (USE) 160B secured by bolts 140 in pockets 143 of proximal housing 222 a distance uphole from the distal housing 220 of FIGS. 3A and 3B. The USE stabilizers 162B1-B4 are sealed by seals 167 in the pockets 143. In this location, the fixed stabilizers 162B1-B4 may be used to maintain centralized stability of the proximal housing 222 within the borehole 12. The USE stabilizers 162B1-B4 are also provided with cavities 201 therein for hosting position components 145, such as three axis magnetometers, three axis accelerometers, gyroscopes, EM (electromagnetic) systems, borehole pressure gauges, BHA returns pressure sensors, short hop telemetry, data transmission, and/or other devices.

Figure 11B:
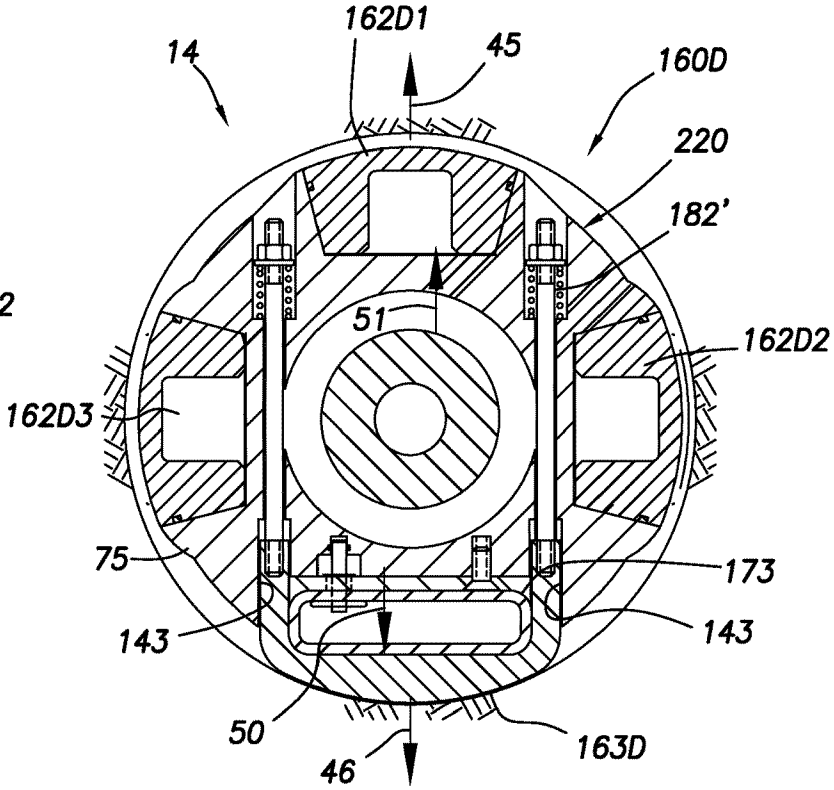
FIGS. 11A-11B are radial cross-sectional views of HDD tools depicting various configurations of stabilizers.
Figure 11A:
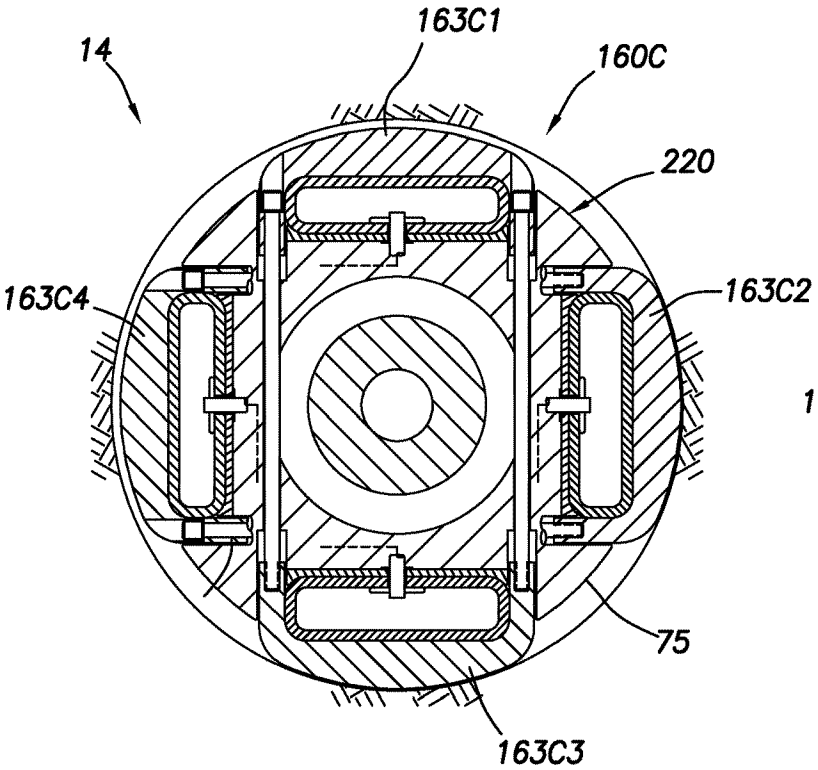

FIG. 11A-11B show example stabilizer configurations 160C,160D usable in the distal housing 220 (and/or other locations about the HDD tool 14). As shown by these figures, the stabilizers may be configured for orientating by outer pipe 75 of the HDD tool 14 to a desired tool-face drill direction from the surface.

FIG. 11A shows a dual DAS configuration 160C including two pairs of adjustable stabilizers 163C1-C4 extendable using the pressurized bladders 176 as described with respect to FIG. 10A. This dual DAS configuration 160C may be provided with surface controlled command capabilities that allows for extension and/or retraction of one or more of the stabilizers 163C1-C4 from all directions. The stabilizers 163C1-C4 may be used to provide lateral forces against the borehole wall, thereby biasing the HDD tool 14 in a desired tool-face direction, while drill-string is in rotation and advancing, making bore-hole into formation.

Any two contiguous adjustable stabilizers of 163C1-C4 may be selectively extended to bias HDD tool 14 to desired tool-face direction, while the HDD tool 14 is rotating or non-rotating. In this example, the hydraulics, electronics and/or other devices used to activate the stabilizers 163C1-C4 may be positioned in other housings or portions of the HDD tool 14.

FIG. 11B shows a single-acting adjustable stabilizer (SAS) configuration 160D including three fixed stabilizers 162D1-D3. Upon pressurizing bladder 176, the adjustable stabilizer 163D laterally extends stabilizer shoe 173 from pocket 143 to apply a force (arrow 50) against the wall at position 180° (arrow 46). This force 50 produces an opposite reactionary force (arrow 51) across the distal housing 220 and produces a tool-face direction (arrow 45), thereby biasing drilling to borehole wall position 0° (arrow 45). Periodically, penetration into the formation may be paused to rotate the outer drill-string to assure suspension of settled solids from returns 30 which may accumulate within the interior of the HDD tool 14 and dual-pipe drill string as described further herein.

Figure 12B:
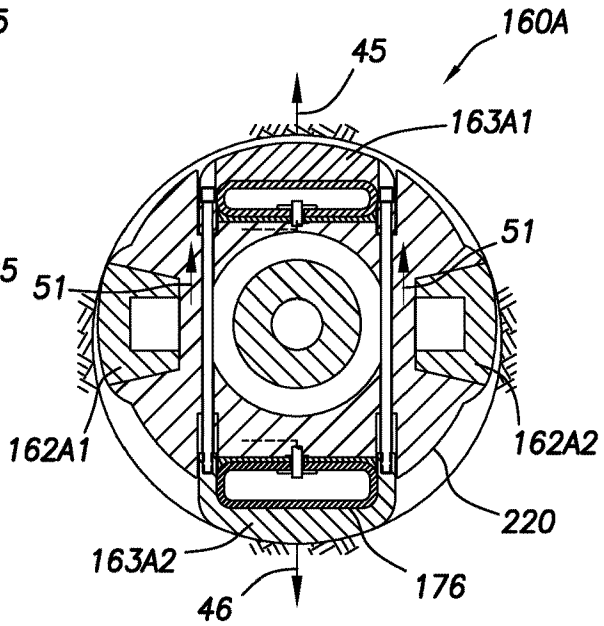
FIG. 12B is a cross-sectional view of the portion of the HDD tool of FIG. 12A taken along lines 12B-12B.
Figure 12A:
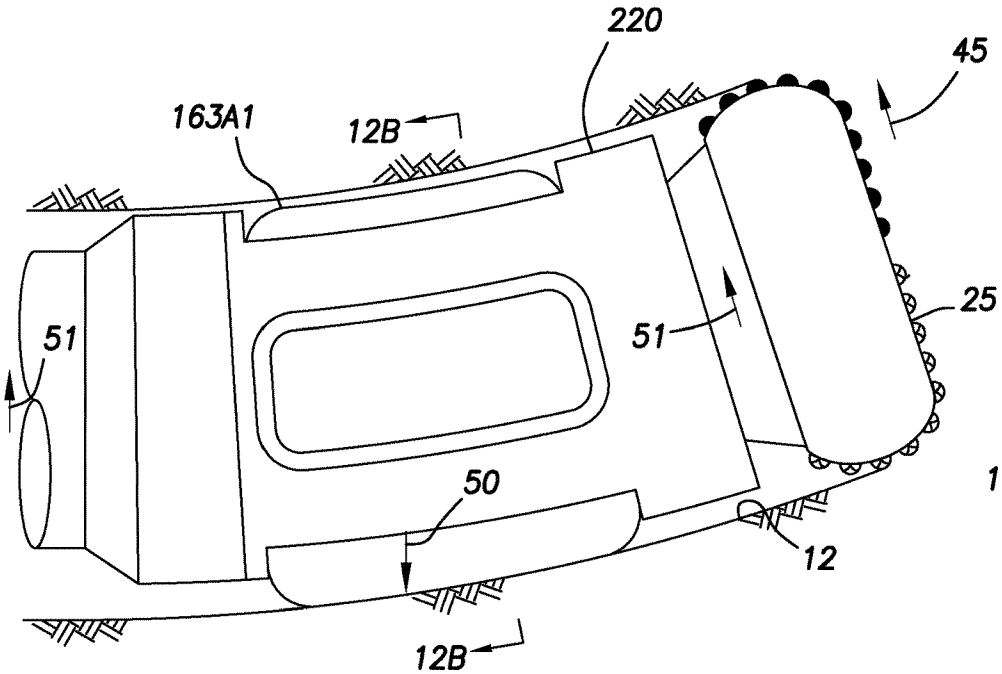
FIG. 12A shows a portion of the HDD tool of FIG. 4 during biasing upward drilling.

FIGS. 12A and 12B illustrate operation of the DAS configuration 160A of FIG. 10A. As shown in these figures, the adjustable stabilizers 163A1, A2 may be activated to apply an upward lateral drilling bias to the distal housing 220. In this example, the adjustable stabilizer 163A2 is orientated to 180° borehole position (arrow 46). The adjustable stabilizer 163A2 is energized by pressurizing bladder 176, thereby extending the adjustable stabilizer 163A2 downward (arrow 50) against the wall of the borehole 12. This results in a reactionary force (arrow 51) which causes the distal housing 220 to forcefully drill in an upward tool-face 0° direction (arrow 45).

Figure 13B:
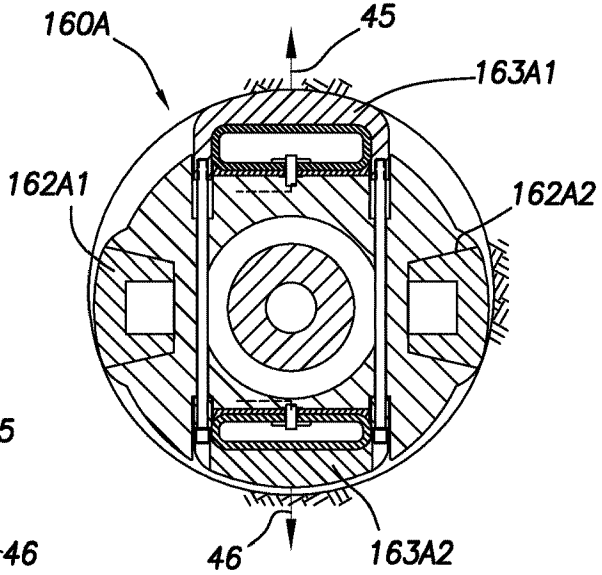
FIG. 13B is a cross-sectional view of the portion of the HDD tool of FIG. 13A taken along lines 13B-13B.
Figure 13A:
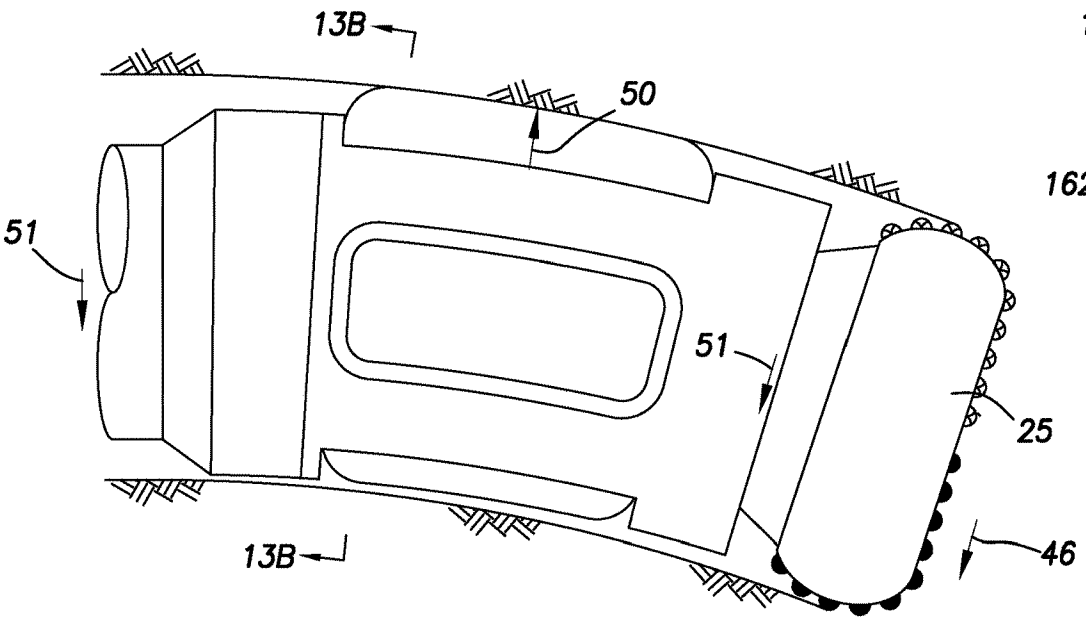
FIG. 13A shows a portion of the HDD tool of FIG. 4 during biasing downward drilling.

FIGS. 13A and 13B illustrate a procedure to drill in a downward direction. By holding the same orientation as described in Figure FIGS. 12A and 12B, the DAS configuration 160A may also be used to apply force vector (see arrow 50) against borehole wall at 0° borehole position (arrow 45), by energizing adjustable stabilizer 163A1, which in turn produces a reactionary force (see arrow 51) through distal housing 220 and bit 25, biasing drilling downward to an intended 180° direction (arrow 46). The stabilizers 163A1,A2 may be activated at various angles to steer drilling in a desired direction.

Figure 14B:
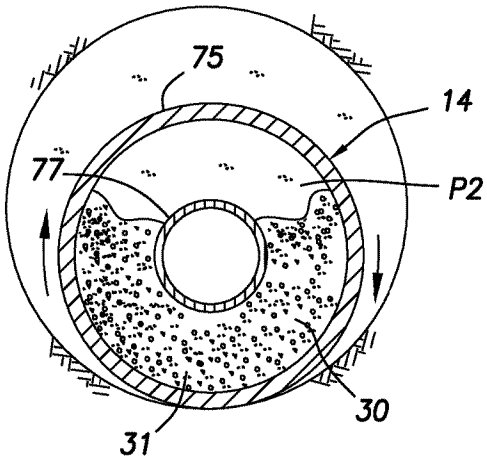
FIG. 14B shows the cross-sectional view of the HDD tool of FIG. 14A after settling of solids about the HDD tool.
Figure 14A:
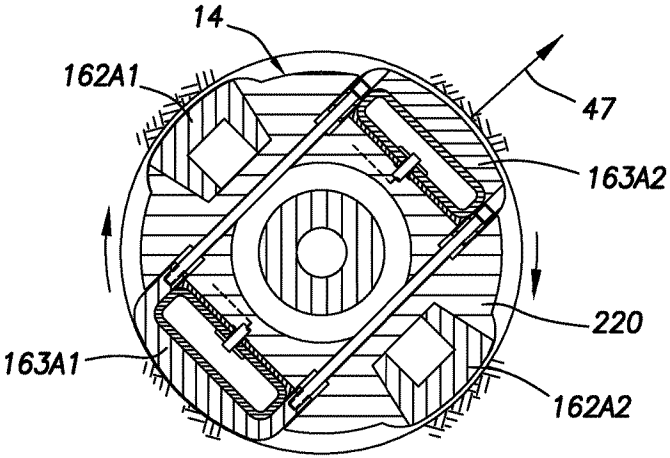
FIG. 14A shows a cross-sectional view of the HDD tool of FIG. 4 during drilling at a fixed tool-face orientation.

As shown by FIG. 14A, the stabilizers 163A1,A2 may be activated to manipulate drilling in a manner that disrupts settling of entrained solids 31 of returns 30 within the HDD tool 14. As shown in FIG. 14A, the stabilizers 163A1,A2 may be selectively activated to apply forces to the wall of the borehole 12 and to shift the HDD tool 14 within the borehole 12. As shown in FIG. 14A, the adjustable stabilizers 163A1 may be oriented within the distal housing 220 to provide a tool-face (arrow 47) orientated to a 45° tool-face. The stabilizer 163A1 may then be energized to laterally bias drilling to this 45° direction at arrow 47. The drilled-mud returns 30 may be conveyed along the path of the passage P2 between outer pipe 75 and inner-pipe 77, as shown in FIG. 14B.

Figure 15B:
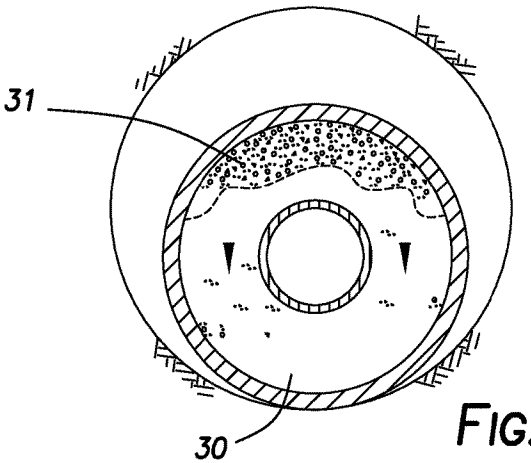
FIG. 15B shows of the HDD tool of FIG. 15A after unsettling of the solids about the HDD tool.
Figure 15A:
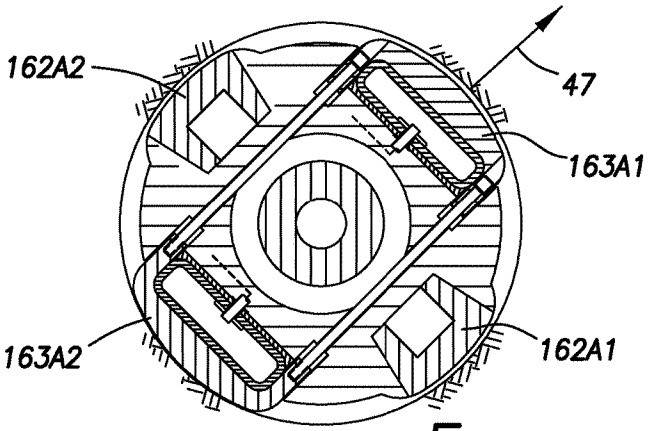
FIG. 15A shows a cross-sectional view of the HDD tool of FIG. 14A rotated 180 degrees.

Over a period of time, entrained solids 31 within the returns 30 may settle-out within a bottom portion of the outer-pipe 75 and restrict returns flows through the tool. To dislodge and enter the settled solids 31 back into suspension, the pair of stabilizers 163A1,A2 may be selectively rotated 180 degrees as shown in FIG. 15A. In this position, the stabilizer 163A2 may be activated along the same arrow 47 to maintain the drilling 45° tool-face direction while allowing the settled solids 31, as shown in FIG. 14B, to un-settle into returns 30 flow, as shown in FIG. 15B. The HDD tool 14 may be selectively and periodically rotated and re-oriented 180 degrees (or other angle) from the surface during drilling to provide a tool face orientation that also allows disruption of the solids 31 within the HDD tool 14.

The DAS configurations with adjustable stabilizers may be operated in various modes. For example, in one mode, the outer surface of the HDD tool 14 may be orientated to desired tool-face with the adjustable stabilizers are radially positioned to bias the HDD tool 14 to a tool-face such that the HDD tool 14 is thrust (or slid) ahead without rotation to slide the HDD tool 14 through the borehole.

In another example mode, the adjustable stabilizers may be dynamically and forcefully positioned against the borehole wall to bias the HDD tool to a selected tool-face while drill-string is in continuous rotation. The ability to directionally steer, while an outer surface of the HDD tool 14 is in rotation may be used to maintain suspension of the solids 31 in the returns 30 are being conveyed throughout the HDD tool 14 and dual pipe drill-string.

With the DAS configurations, it may not be necessary to pause drilling in order to rotate the outer drill-string to suspend the settled solids 31. The DAS configurations may be activated by surface command to reorient the HDD tool 14 to another tool-face angle. For example, the outer pipe of the HDD tool 14 may be rotated 180 degrees, thereby rotating the adjustable stabilizers 163A1,A2 to an opposite radial position. In other words, the pair of stabilizers 163A1, A2 switch radial positions such that the settled solids within the HDD tool 14 are disrupted while maintaining the same drilling course.

Figure 16:
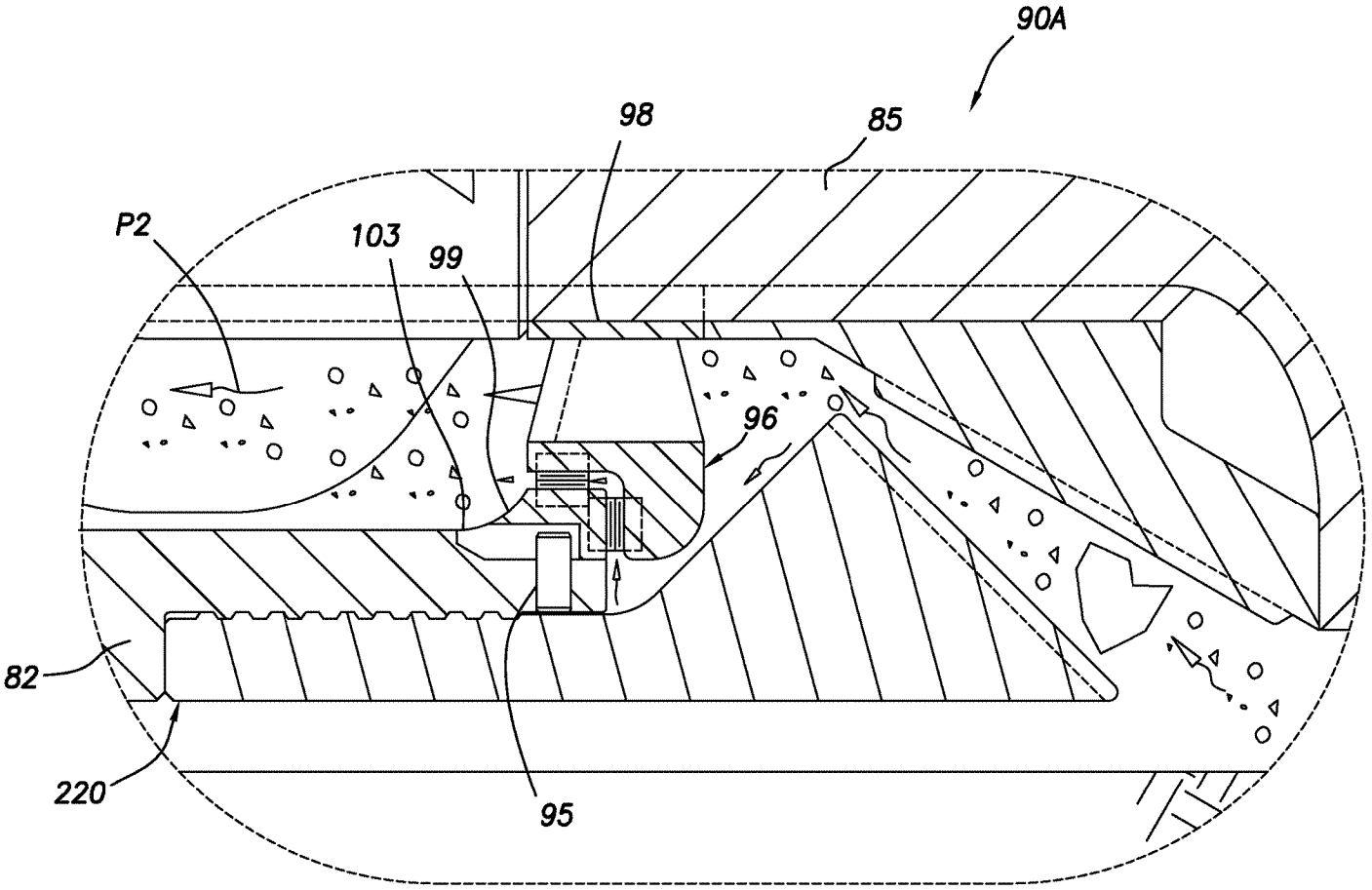
FIG. 16 is a detailed view of a portion 16 of the HDD tool of FIG. 5B depicting a support.

FIGS. 16-19B show various configurations of supports 90A,90B usable to support the tubular shaft 85 (and/or shaft portions 183, 185, 198 of FIG. 5B), within the HDD tool 14. FIG. 16 shows a detailed view of a portion 16 of FIG. 5B depicting the support 90A as a radial and thrust bearing. FIGS. 17A and 17B show views of the support 90B in the form of a radial carrier bearing. FIGS. 18A-19B show various views of inner and outer bearing races 96, 99 usable the support 90, 90A, 90B.

As shown in FIG. 16, the support 90A may include circular inner bearing race 96 and outer bearing race 99 secured to the tubular shaft 85. The inner bearing race 96 may be rotatably secured to the tubular shaft 85 by splines 98, and supported against the stabilizer housing 82 of the distal housing 220. The outer bearing race 99 may be rotatably fixed within housing slot 103 by the anti-rotation pins 95. The supports 90 may axially fix the tubular shaft 85 within the distal housing 220 by securing the inner races 96 between a shoulder of the distal housing 220 and bit shaft locking nut 87 (as shown FIG. 5B).

As shown in FIG. 16, the inner bearing races 96 and outer bearing race 99 are positioned along the path of the passage P2 such that flow of returns cools and lubricates the bearing disks of the bearing races 96,99. The inner bearing race 96 may have an inner diameter positioned in an interference fit about the tubular shaft 85. The bearing races 96,99 may be positioned in engagement with the stabilizer housing 82. The anti-rotation pin 95 may extend from the stabilizer housing 82 and into the outer bearing race 99 to prevent rotation therebetween.

Figure 18B:
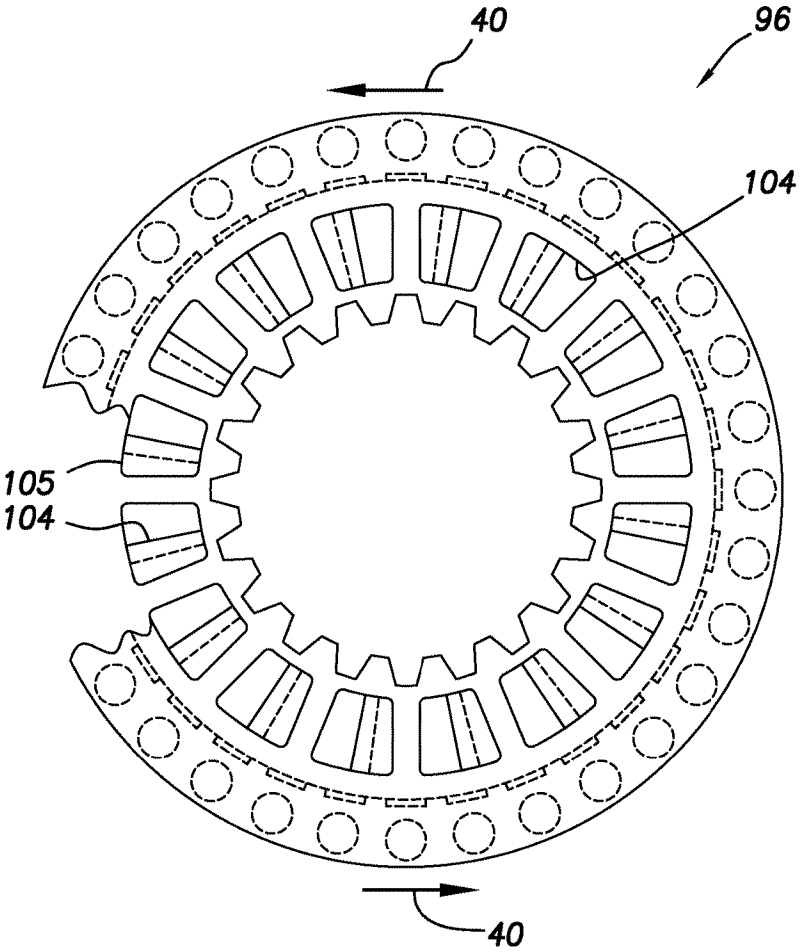
FIGS. 18A and 18B are side and front views, respectively of a bearing inner race.
Figure 18A:
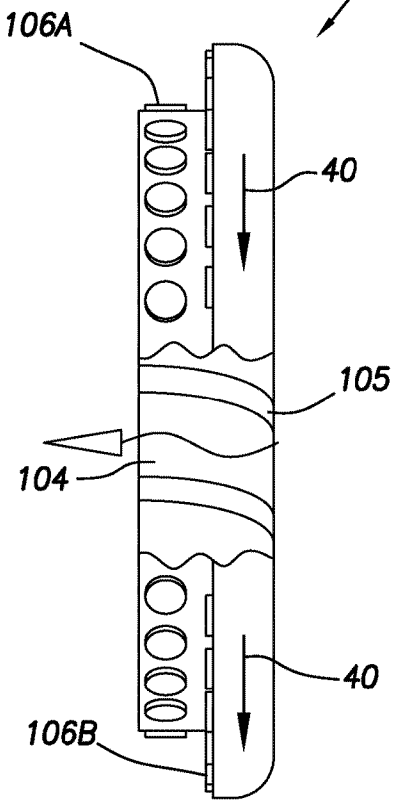

FIGS. 18A and 18B show a ring shaped, rotatable inner bearing race 96 (rotatable as indicated by arrows 40). The inner bearing race 96 may be shaped to form a fluid turbine rotor to enhance flow. Passageways 104 extend through the bearing race channel 105 to permit fluid to pass through the path of the passage P2. Surfaces about the passageways 104 and/or channel 105 may be shaped like fan or turbine blades to urge fluid flow thereby. As also shown, the passageways 104 may have various flow enhancing shapes. The inner bearing race 96 may function as a minor propulsor element to further urge flow of the returns 30 through the HDD tool 14. Radial bearing disks 106A and thrust bearing disks 106B may also be provided along the inner bearing race 96 to matingly bears against radial bearing disks 108A and thrust bearing disks 108B of outer bearing race 99.

Figure 19B:
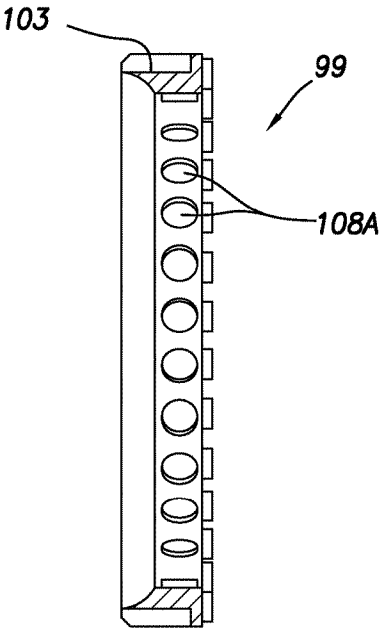
FIGS. 19A and 19B are front and side views, respectively, of a bearing outer race.
Figure 19A:
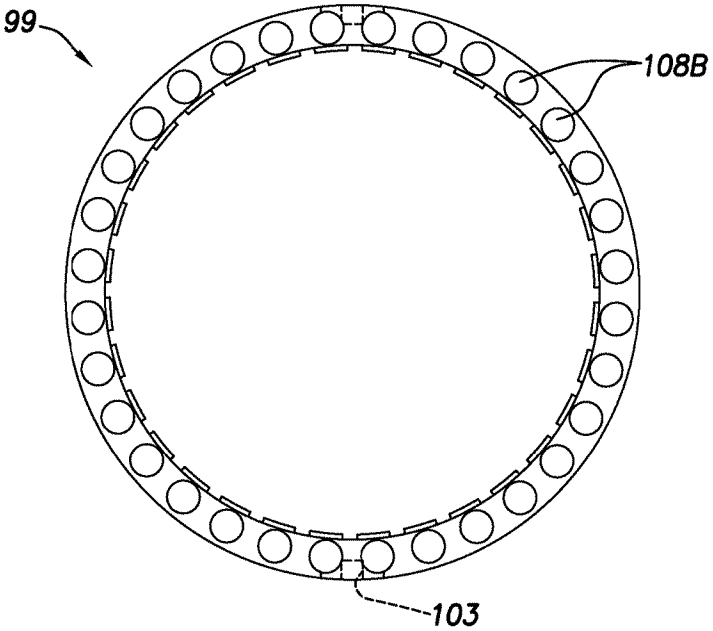
Figure 19C:
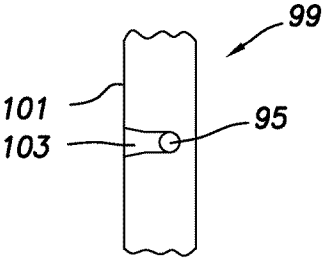
FIG. 19C is a detailed view of a portion of the bearing outer race with the anti-rotation pin.

FIGS. 19A and 19B show the outer bearing race 99. The outer bearing race 99 may be disposed within cavity 102 of the distal housing 220 and rotatably fixed by anti-rotation pin 95 such that the returns 30 pass through passageways 101 of the outer bearing race 99 (see, e.g., FIGS. 19A,19B). The outer bearing race 99 may have the housing (or anti-rotating docking) slot 103 for receiving the anti-rotation pin 95. The outer bearing 99 may be provided with radial/thrust bearing disks 108A,B for wear. The bearing disks 106A,B and 108A,B may be made of a hardened material for wear resistance and to provide a bearing surface with a low coefficient of friction therebetween.

Figure 17A:
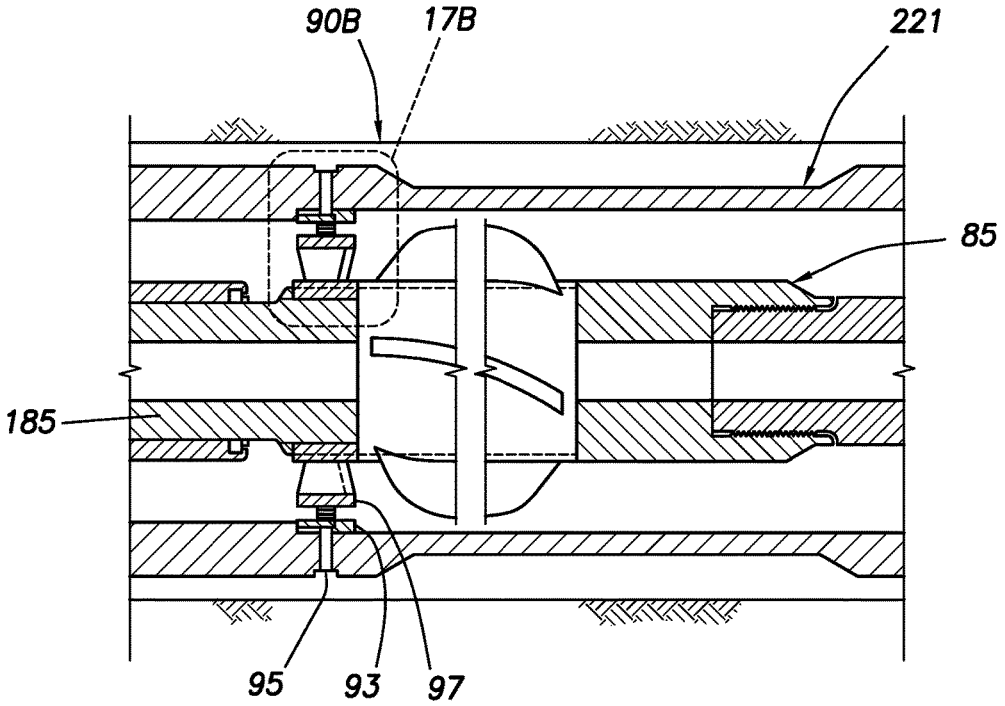
FIG. 17A is a longitudinal, cross-sectional view of a portion 17A of the HDD tool of FIG. 3B having supports.
Figure 17B:
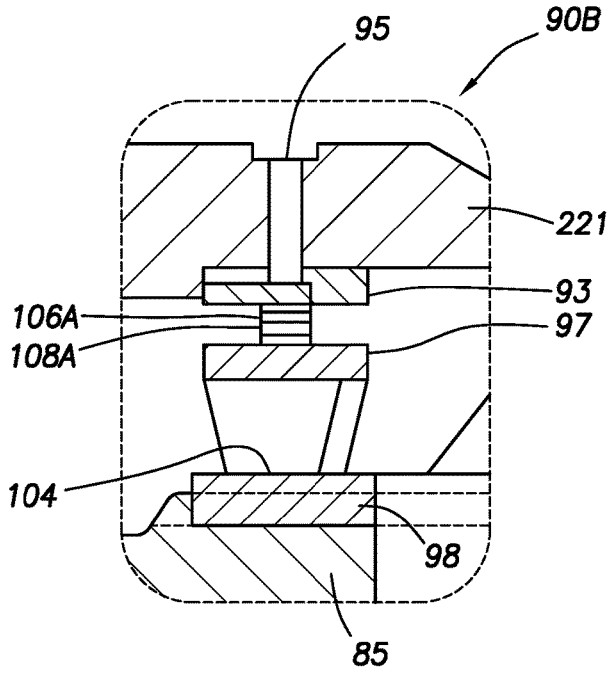
FIG. 17B is a detailed view of a portion 17B of the HDD tool of FIG. 17A.

FIGS. 17A and 17B show another support 90B usable as the support 90. In this version, the support 90B is a radial bearing assembly including an inner bearing race 96 and an outer bearing race 93 supported along the shaft portion 185 of the tubular shaft 85 in the coupling housing 221. Inner bearing race 96 is rotatably fixed, by splines 98, to rotatably the shaft portion 185. Outer bearing race 93 is rotatably fixed, by anti-rotation pin 95, to coupling housing 221. The bearing disks 108A may also be provided along the outer bearing race 93 to bear against bearing disks 108A along the inner race 96. A portion of the returns 30 may flow through multiple fan or turbine shaped passageways 104 formed within inner bearing race 96. A portion of the returns 30 may flow passes through and around bearing disks 106A, 108A for lubrication and cooling thereof.

Figure 20:
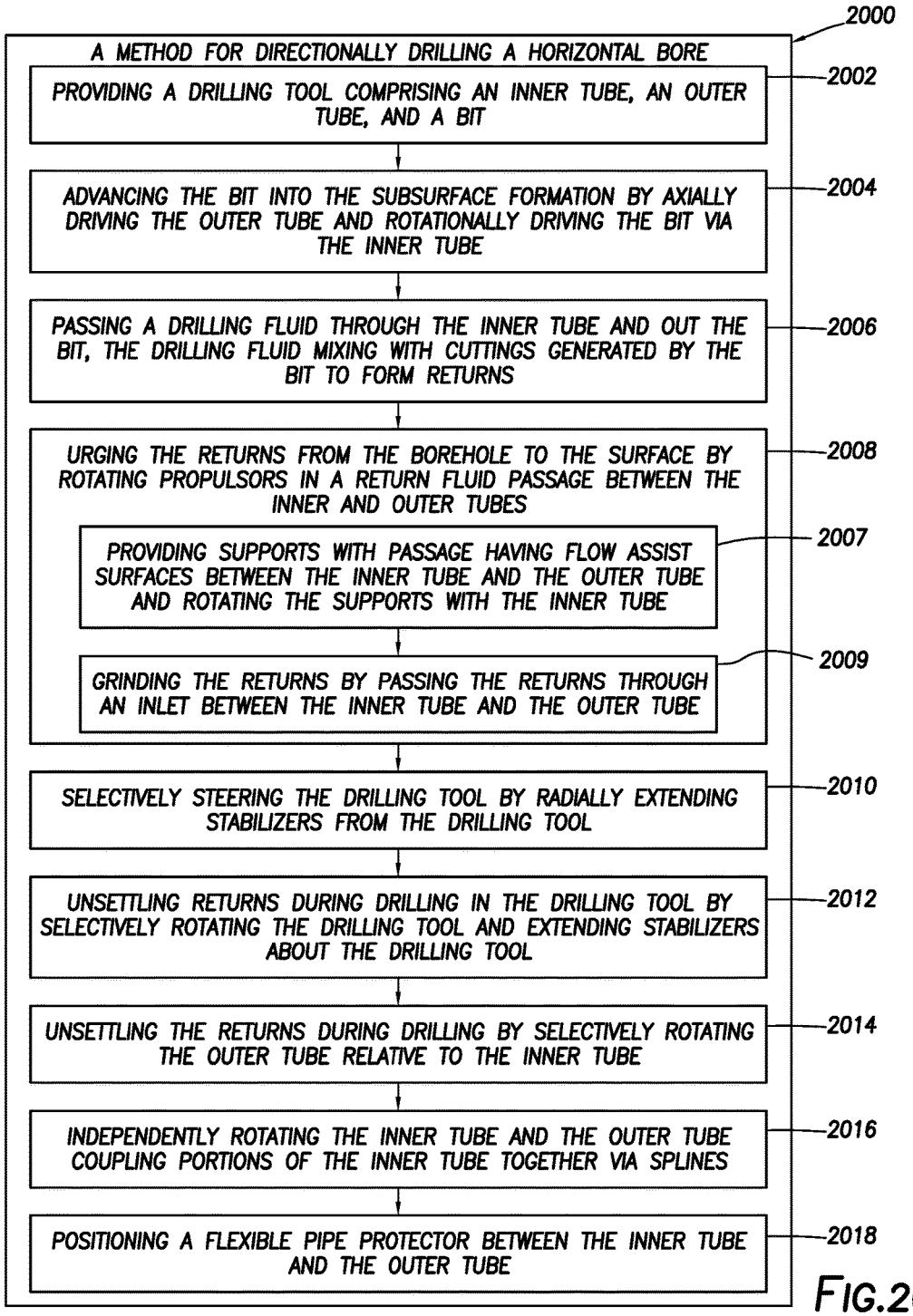
FIG. 20 is a flow chart depicting a method of horizontally drilling a subsurface borehole.

FIG. 20 is a flow chart depicting a method 2000 of directionally drilling a horizontal bore (or subsurface borehole). The method 2000 involves 2002—providing a drilling tool comprising an inner tube, an outer tube, and a bit; 2004—advancing the bit into the subsurface formation by axially driving the outer tube and rotationally driving the bit via the inner tube; 2006—passing a drilling fluid through the inner tube and out the bit, the drilling fluid mixing with cuttings generated by the bit to form returns; and 2008—urging the returns from the borehole to the surface by rotating propulsors (and/or other rotational drivers) in a return flow passage between the inner and outer tubes. The urging may involve 2007—providing supports with passage having flow assist surfaces between the inner tube and the outer tube and rotating the supports with the inner tube, and 2009—grinding the returns by passing the returns through an inlet between the inner tube and the outer tube.

The method may also involve 2010—selectively steering the drilling tool by radially extending stabilizers from the drilling tool, 2012—unsettling returns during drilling in the drilling tool by selectively rotating the drilling tool and extending stabilizers about the drilling tool, 2014—unsettling the returns during drilling by selectively rotating the outer tube relative to the inner tube, 2016—independently rotating the inner tube and the outer tube and/or coupling portions of the inner tube together via splines, and/or 2018—positioning a flexible pipe protector between the inner tube and the outer tube. Other features may be provided, such as controlling a ratio between a rate of the advancing and a rate of the passing.

The method may also involve controlling a ratio between a rate of the advancing (e.g., rate of penetration during drilling) and a rate of the passing (e.g., a rate of drill-fluid input flow through the bit). The drilling and fluid parameters may be sensed, regulated, and/or controlled to manage a selected ration between the rates. The ROP (rate of penetration) during drilling of soft horizontal boreholes, without sufficient volume of drilling mud applied to the bit cuttings will overload returns with solids. Returns overloaded by solids, requires greater pressure to move returns, thereby inducing damage to the borehole and frac-outs. A common soft ground drilling occurrence is where the ROP increases, but volume of in-put drilling mud remains unchanged, whereby returns along returns passageway, becomes inconsistent and flow problematic.

Part or all of the method 2000 may be performed in any order, and repeated as desired.

While the embodiments are described with reference to various implementations and exploitations, it will be understood that these embodiments are illustrative and that the scope of the inventive subject matter is not limited to them. Many variations, modifications, additions and improvements are possible. For example, various combinations of one or more of the features provided herein may be used.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

Insofar as the description above and the accompanying drawings disclose any additional subject matter that is not within the scope of the claim(s) herein, the inventions are not dedicated to the public and the right to file one or more applications to claim such additional invention is reserved. Although a very narrow claim may be presented herein, it should be recognized the scope of this invention is much broader than presented by the claim(s). Broader claims may be submitted in an application claims the benefit of priority from this application.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A horizontal directional drilling tool for drilling a borehole through a subsurface formation between locations about a surface, the drilling tool comprising:

a bit;

an outer tube coupled to a surface driver;

an inner tube coupled between the surface driver and the bit to translate rotation therebetween, the inner tube having a drilling fluid passage therethrough, the inner tube positioned within the outer tube to define a return flow passage therebetween; and rotational drivers comprising a series of propulsors positioned along the inner tube, each of the propulsors comprising blades circumferentially distributed about a portion of the inner tube, each of the blades extending into the return flow passage and rotationally driven therein whereby returns in the borehole are urged uphole.

2. The drilling tool of claim 1, wherein an inlet to the return flow passage is defined between the outer tube and the bit to receive returns from the borehole.

3. The drilling tool of claim 2, wherein the outer tube has an outer cone and the bit has an inner cone, the inlet positioned between the inner cone and the outer cone.

4. The drilling tool of claim 3, wherein the inner cone and the outer cone each have an angled surface, the inlet tapered between the angled surfaces to define a returns grinder.

5. The drilling tool of claim 1, wherein the inner tube has an upset on a distal end thereof and the bit has an inner cone having an opening to receive the upset.

6. The drilling tool of claim 2, wherein the inlet to the return flow passage is defined between an angled inlet surface of the outer tube and an angled outer surface of the bit, the inlet having a narrowing tapered shaped to break down cuttings generated by the bit from the borehole.

7. The drilling tool of claim 1, wherein the rotational drivers comprise a pipe protector between the inner tube and the outer tube.

8. The drilling tool of claim 7, wherein the pipe protector comprises a flexible blade rotatably extending from the inner tube, the flexible blade comprising an elastomeric material.

9. The drilling tool of claim 8, wherein the flexible blade has a helical shape with a flow assist surface.

10. The drilling tool of claim 1, further comprising stabilizers positionable about the outer tube and engagable with a wall of the borehole.

11. The drilling tool of claim 10, wherein the stabilizers comprise one of: fixed stabilizers, adjustable stabilizers, and combinations thereof.

12. The drilling tool of claim 11, wherein the fixed stabilizers are fixedly positioned within a pocket extending into an outer surface of the outer tube, the fixed stabilizers having a cavity therein to storingly receive components therein.

13. The drilling tool of claim 11, wherein the adjustable stabilizers are radially extendable and retractable from an outer surface of the outer tube.

14. The drilling tool of claim 13, further comprising an inflatable bladder, backing plate, and draw bolts coupled to the adjustable stabilizers to selectively extend and retract the adjustable stabilizers.

15. The drilling tool of claim 1, wherein a first portion of the outer tube and the inner tube comprises a drill string and a second portion of the outer tube and the inner tube comprises a bottom hole assembly.

16. The drilling tool of claim 15, further comprising at least one x-over sub coupled between the drill string and the bottom hole assembly.

17. The drilling tool of claim 15, wherein the outer tube of the bottom hole assembly comprises a distal housing and a proximal housing, with a coupling housing therebetween.

18. The drilling tool of claim 15, wherein the inner tube comprises tubular shafts connected in series with the drilling fluid passage extending therethrough.

19. The drilling tool of claim 18, further comprising a spline connection between at least one adjacent pair of the tubular shafts.

20. The drilling tool of claim 1, wherein the drilling fluid passage of the inner tube is in fluid communication a bit passage through the bit to pass a drilling fluid therethrough.

21. The drilling tool of claim 1, further comprising supports positioned between the inner tube and the outer tube.

22. The drilling tool of claim 21, wherein the supports comprise at least one of a radial and thrust bearing, a radial carrier bearing, and combinations thereof.

23. The drilling tool of claim 21, wherein the supports comprise an inner bearing race and an outer bearing race.

24. The drilling tool of claim 23, wherein the rotational drivers further comprise flow assist surfaces positioned about flow passages of the inner bearing race.

25. The drilling tool of claim 21, wherein the inner tube and the outer tube are one of: independently and integrally coupled to the surface driver.

26. A horizontal directional drilling system for drilling a borehole through a subsurface formation between locations about a surface, the drilling system comprising:

a surface driver; and a horizontal directional drilling tool, comprising:

a bit;

an outer tube coupled to the surface driver;

an inner tube coupled between the surface driver and the bit to translate rotation therebetween, the inner tube having a drilling fluid passage therethrough, the inner tube positioned within the outer tube to define a return flow passage therebetween; and rotational drivers comprising a series of propulsors positioned along the inner tube, each of the propulsors comprising blades circumferentially distributed about a portion of the inner tube, each of the blades extending into the return flow passage and rotationally driven therein whereby returns in the borehole are urged.

27. The drilling system of claim 26, further comprising a mud pump coupled to the drilling tool to pass a drilling fluid through the drilling fluid passage.

28. The drilling system of claim 26, further comprising a solids control coupled to the drilling tool to receive returns from the return flow passage.

29. A method for directionally drilling a horizontal borehole through a subsurface formation between locations about a surface, the method comprising:

providing a drilling tool comprising an inner tube, an outer tube, propulsors, and a bit, the inner tube positioned within the outer tube to define a return flow passage therebetween;

positioning a series of the propulsors positioned along the inner tube, each of the propulsors comprising blades circumferentially distributed about a portion of the inner tube, each of the blades extending into the return flow passage;

advancing the bit into the subsurface formation by axially driving the outer tube and rotationally driving the bit via the inner tube;

passing a drilling fluid through the inner tube and out the bit, the drilling fluid mixing with cuttings generated by the bit to form returns; and urging the returns from the borehole to the surface by rotating rotational drivers the propulsors in a return flow passage between the inner tube and the outer tube.

30. The method of claim 29, further comprising selectively steering the drilling tool by radially extending stabilizers from the drilling tool.

31. The method of claim 29, further comprising independently rotating the inner tube and the outer tube.

32. The method of claim 29, further comprising coupling portions of the inner tube together via splines.

33. The method of claim 29, further comprising unsettling returns during drilling in the drilling tool by selectively rotating the drilling tool and extending stabilizers about the drilling tool.

34. The method of claim 29, further comprising unsettling the returns during drilling by selectively rotating the outer tube relative to a tool face position of the inner tube.

35. The method of claim 29, further comprising grinding the returns by passing the returns through an angled inlet between the inner tube and the outer tube.

36. The method of claim 29, further comprising positioning a flexible pipe protector between the inner tube and the outer tube.

37. The method of claim 29, further comprises providing supports with passage having flow assist surfaces between the inner tube and the outer tube and rotating the supports with the inner tube.

38. The method of claim 29, further comprising controlling a ratio between a drilling rate of the advancing and a pumping rate of the passing.

39. A horizontal directional drilling tool for drilling a borehole through a subsurface formation between locations about a surface, the drilling tool comprising:

a bit;

an outer tube coupled to a surface driver;

an inner tube coupled between the surface driver and the bit to translate rotation therebetween, the inner tube having a drilling fluid passage therethrough, the inner tube positioned within the outer tube to define a return flow passage therebetween;

supports positioned between the inner tube and the outer tube, the supports comprising an inner bearing race and an outer bearing race; and rotational drivers comprising propulsors coupled to the inner tube, the propulsors comprising blades extending into the return flow passage and rotationally driven therein whereby returns in the borehole are urged uphole.

40. The drilling tool of claim 39, wherein the rotational drivers further comprise flow assist surfaces positioned about flow passages of the inner bearing race.

41. A horizontal directional drilling tool for drilling a borehole through a subsurface formation between locations about a surface, the drilling tool comprising:

a bit;

an outer tube coupled to a surface driver;

an inner tube coupled between the surface driver and the bit to translate rotation therebetween, the inner tube having a drilling fluid passage therethrough, the inner tube positioned within the outer tube to define a return flow passage therebetween;

adjustable stabilizers positionable about the outer tube and engagable with a wall of the borehole; the adjustable stabilizers comprising an inflatable bladder, backing plate, and draw bolts to selectively extend and retract the adjustable stabilizers; and rotational drivers comprising propulsors coupled to the inner tube, the propulsors comprising blades extending into the return flow passage and rotationally driven therein whereby returns in the borehole are urged uphole.

42. A method for directionally drilling a horizontal borehole through a subsurface formation between locations about a surface, the method comprising:

providing a drilling tool comprising an inner tube, an outer tube, and a bit;

advancing the bit into the subsurface formation by axially driving the outer tube and rotationally driving the bit via the inner tube;

passing a drilling fluid through the inner tube and out the bit, the drilling fluid mixing with cuttings generated by the bit to form returns;

urging the returns from the borehole to the surface by rotating rotational drivers in a return flow passage between the inner tube and the outer tube; and unsettling returns during drilling in the drilling tool by selectively rotating the drilling tool and extending stabilizers about the drilling tool.

* * * * *